US012435948B2

(12) United States Patent
Angers, Jr.

(10) Patent No.: US 12,435,948 B2
(45) Date of Patent: Oct. 7, 2025

(54) ADJUSTABLE, PIVOTING GUN STOCK AND METHOD OF USE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 0 days.

(21) Appl. No.: 18/600,392

(22) Filed: Mar. 8, 2024

(65) Prior Publication Data

US 2024/0255251 A1 Aug. 1, 2024

Related U.S. Application Data

(63) Continuation-in-part of application No. 17/736,836, filed on May 4, 2022, now Pat. No. 11,953,289, which is a continuation-in-part of application No. 17/538,550, filed on Nov. 30, 2021, now Pat. No. 11,732,998.

(51) Int. Cl.
*F41C 23/00* (2006.01)
*F41C 23/14* (2006.01)

(52) U.S. Cl.
CPC ..... *F41C 23/14* (2013.01)

(58) Field of Classification Search
CPC ..... F41C 23/04; F41C 23/20; F41C 23/14; F41A 11/04; F41G 1/17
USPC ..... 42/75.03, 73, 71.01, 75.01, 75.1
See application file for complete search history.

(56) References Cited

U.S. PATENT DOCUMENTS

| | | | | | |
|---|---|---|---|---|---|
| 243,553 | A * | 6/1881 | Hape et al. | F41C 23/14 | 42/73 |
| 371,850 | A * | 10/1887 | Maynard | F41A 15/14 | 42/75.01 |
| 476,246 | A * | 6/1892 | Burgess | F41A 9/18 | 42/74 |
| 843,227 | A * | 2/1907 | Munson | F41C 23/14 | 42/73 |
| 1,295,688 | A * | 2/1919 | Butler | F41A 23/08 | 42/94 |
| 1,468,354 | A * | 9/1923 | Caretto | F41C 23/14 | 42/74 |
| 1,480,350 | A * | 1/1924 | Martin | F41C 23/14 | 42/74 |
| 1,524,973 | A * | 2/1925 | Hazelton | F41A 23/08 | 248/168 |

(Continued)

*Primary Examiner* — Michael D David
(74) *Attorney, Agent, or Firm* — JOSEPH T REGARD LTD PLC

(57) ABSTRACT

An adjustable shoulder rest for a rear stock for a rifle or shotgun, with features to customize the shoulder to firearm interface, providing diverse adjustment options pursuant to user preference and/or circumstances of use. The present invention further provides a pivotal shoulder rest to facilitate customized position adjustment to the firearms orientation vis-a-vis the operator, including the option to provide a pivotal or swivel connection for adjustment of the firearm during operation as well as the option of providing haptic feedback or pivotal resistance with return-to-center capability to communicate to the user useful feedback, and/or facilitate line of sight alignment of the firearm at various angles relative to the longitudinal axis thereof in line with one or more sighting apparatus mounted thereto.

9 Claims, 31 Drawing Sheets

(56) References Cited

U.S. PATENT DOCUMENTS 2,436,349 A * 2/1948 Adams ..... F41A 23/08 124/29
2,453,394 A * 11/1948 Wittman ..... F41C 23/14 42/74
2,754,608 A * 7/1956 Stieffel, Jr. ..... F41C 23/06 42/74
4,300,302 A * 11/1981 Anschutz ..... F41C 23/14 42/73
4,316,342 A * 2/1982 Griggs ..... F41C 23/06 42/74
5,194,678 A * 3/1993 Kramer ..... F16M 11/242 89/37.04
5,933,997 A * 8/1999 Barrett ..... F41C 23/14 42/73
6,698,963 B1 * 3/2004 Parker ..... B62D 7/20 403/130
6,842,015 B2 * 1/2005 Morimoto ..... H03K 17/98 324/661
8,215,045 B2 * 7/2012 Mitchell ..... F41C 23/20 42/72
9,562,740 B1 * 2/2017 Korliker ..... F41C 23/14
10,907,931 B2 * 2/2021 Schoenborn ..... F41C 23/04
11,732,998 B2 * 8/2023 Angers, Jr. ..... F41G 1/17 42/73
11,953,289 B2 * 4/2024 Angers, Jr. ..... F41C 23/14
2002/0050088 A1 * 5/2002 Sharp ..... F41C 23/04 42/73
2007/0253764 A1 * 11/2007 Clayton ..... F16C 11/069 403/122
2012/0311907 A1 * 12/2012 Cottle ..... F41C 23/14 42/71.01
2013/0000175 A1 * 1/2013 Quaedpeerds ..... F41C 23/20 42/73
2016/0187099 A1 * 6/2016 Cottle ..... F41C 23/14 42/73
2023/0168064 A1 * 6/2023 Angers, Jr. ..... F41C 23/14 42/73

* cited by examiner

FIG 7
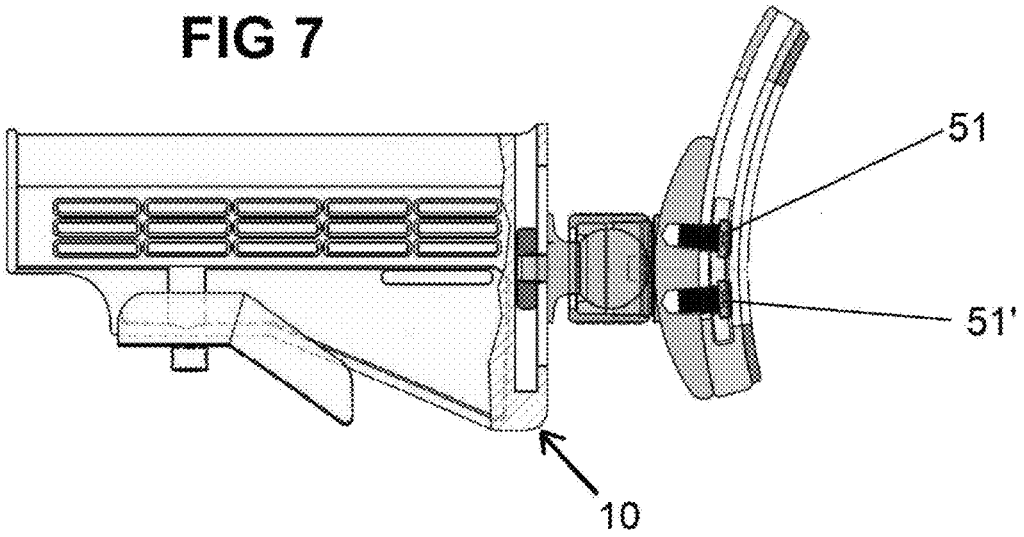
FIG 8
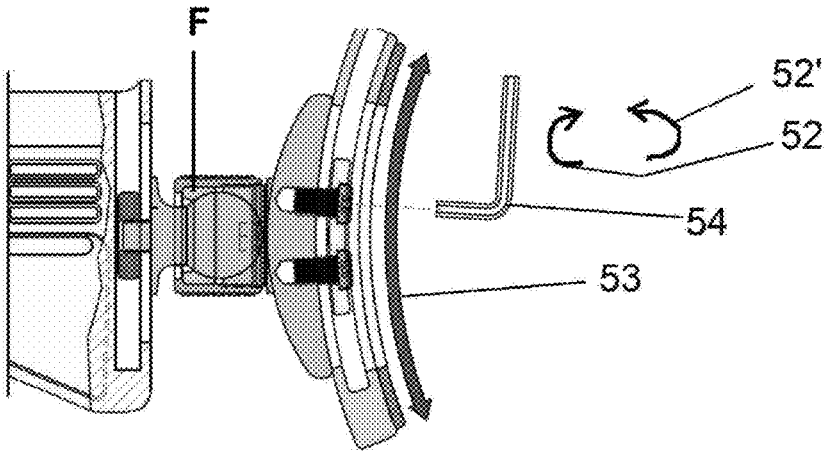
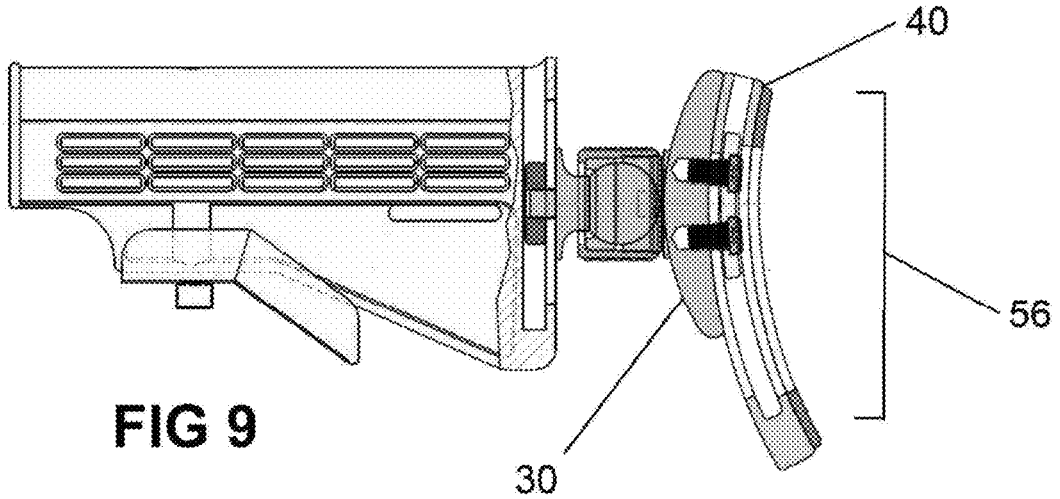
FIG 9

ADJUSTABLE, PIVOTING GUN STOCK AND METHOD OF USE

The present application is a continuation-in-part of U.S. Utility patent application Ser. No. 17/736,836 filed May 4, 2022, which is a continuation-in-part of U.S. Utility patent application Ser. No. 17/538,550 filed Nov. 30, 2021, each listing John W Angers, Jr as inventor, which are incorporated herein in their entirety.

FIELD OF THE INVENTION

The present invention relates long guns including but not limited to firearms and components therefore, and in particular to an adjustable swivel assembly associated with the butt of a gun such as a rifle, shotgun or airgun which can readily provide customizable orientation of the firearm relative to the shoulder of the user, while being easily and quickly re-adjusted depending on user preference and circumstances of use. The present invention provides a pivotal connection to facilitate supported adjustment of the orientation of the firearm via pivoting or rotation which can be locked to a desired position via a swivel lock, a detent system, or haptic feedback system, which can be used to communicate to the user or otherwise facilitate line-of-sight alignment of the firearm at various angles, for example, relative to the longitudinal axis thereof so as to be in line with one or more sighting apparatus mounted thereto, and or to simply provide pivotal support with pivotal resistance and return-to-center features, while providing the user useful feedback, or a swivel connection during operation, while maintaining stable engagement to the user.

GENERAL BACKGROUND DISCUSSION of the INVENTION

While in use, firearms, and in particular long guns including but not limited to rifles, shotguns and the like, generally rest against a shoulder of the user (typically at an area known as the pocket of the shoulder) to provide support for the weapon and provide a line-of-sight anchor point for aiming as well as absorb any recoil during firing. With most fixed gun stocks, the butt of the stock is placed firmly against the shoulder of the user to provide the anchor point, thus providing a limited available swath of movement of the firearm when in use to maintain line of sight, as the user must reposition the shoulder depending on the location (and the required positioning to maintain line of sight) relative to that user.

Repositioning the firearm for line-of-sight aiming outside of a limited range with a fixed stock without repositioning the anchor point (the user's shoulder) may result in partial or insufficient engagement of the firearm to the user's shoulder, which can increase the amount of recoil force at the point of contact with the user, as well as potentially increasing the possibility of injury or discomfort, and decrease the accuracy of any resulting shot.

Recoil pads or the like provided at the butt or distal end of a fixed rear stock can lessen the shock of the recoil and may provide an increased friction coefficient depending on the material used at the point of contact, but will not eliminate the problem of having to adjust the shoulder commensurate with the line of sight to maintain anchor point between each shot, decreasing accuracy, as well as slowing response time if one is required to reposition one's shoulder and reacquire the target between shots.

Further, if the butt-plate of the firearm is not fully seated against the shoulder of the user, rapid repeated firings such as via a semi-automatic or automatic weapon can jar an unstable anchor point at the user's shoulder and possibly force repositioning of the butt-plate vis a vis the shoulder, resulting in reduced accuracy and control, and increase the possibility of injury.

While various prior patents may contemplate limited aspects related to the present invention, none embody the unique combination wherein the pivotal butt-plate is adjustable to the extent provided, nor the functional configuration of the various components of the present invention to accomplish same.

U.S. Pat. No. 4,316,342 to Griggs issued Feb. 23, 1982 illustrates a device designed to facilitate pivotal repositioning of the rear stock of the firearm relative to the user for recoil dampening/absorption. See also Wittman 2543394 issued Nov. 9, 1948.

U.S. Pat. No. 843,227 to Munson issued Feb. 5, 1907 and 243553 to Hape et al issued Jun. 28, 1881 illustrate pivoting rear stocks are adjustable to optimize the configuration for the user and circumstances of use.

Patent Application Publication US2013/0000175A1 to Quaedpeerds et al published Jan. 3, 2013 provides a rear stock having an end with recoil pad engaged thereto via ball joint which can be adjustably positioned, so as to facilitate adjustment pad to best engage the shooter in use.

U.S. Pat. No. 8,215,045 teaches a ball and socket assembly used to pivotally mount and secure, via straps or the like, the buttstock of an assault rifle to the shoulder of a user, to stabilize same and maintain position during operation.

SUMMARY DISCUSSION OF THE INVENTION

The present invention provides a uniquely adjustable, pivotable butt-plate adjustably emanating from the rear stock of a rifle or shotgun, which is configured to facilitate optimal engagement to the shoulder of the user, while providing diverse and various adjustment features to fully customize the shoulder to firearm interface, as well as providing the capability for ready re-configuration to accommodate user preference and circumstances of use.

The present invention is particularly suited for competitive shooting, providing a stable, non-moving anchor point for rifles or the like to keep line of sight anchor point consistent through the motions associated with aiming the firearm while maintaining a firm anchor point for line of sight.

In the present invention, the term "firearm" is intended to reference any gun utilizing a shoulder rest or the like, which can include rifles, shotguns, air guns, etc. Also called "long guns", these include any weapon braced against the shoulder when fired. Accordingly, the user of "firearm" or "gun" or the like is not intended to be limiting.

A ball joint built associated with the butt end of the gun stock provides an enhanced anchoring for the rifle to provide an expanded target acquisition area for line-of-sight aiming, while maintaining a stable anchor point at the user's shoulder, and allowing for pivotal readjustment at the anchor point via a pivotal, ball and socket connection. While this is particularly useful in competitive shooting, law enforcement as well as military use, as well as other situations, this system is believed to provide a significant performance enhancement over prior systems.

The original, first embodiment of the present invention utilizes a first slot formed along the butt of the rear stock and having an opening formed along the rear edge of the stock.

A second slot emanating from the butt end of the rear stock engages the first slot. The first slot is formed to slidingly receive a ball joint retainer, which has a threaded passage formed therethrough to engage a pivot ball having a base via a threaded portion emanating from said base and passing through a second slot at the end of the stock to engage pivot ball retainer (in the second slot) via its threaded passage, so that the base of the pivot ball rests against the butt end of the rear stock.

An enveloping nut with friction washer and adjustable buttstock connector combination engage the pivot ball to provide a ball and socket-type swivel connection, while allowing the ball to be adjustably situated along the butt end of the buttstock, via the slotted connection.

The cylindrical nut has first and second ends, each forming an opening, and is provided to slide over and partially envelope the ball portion of the pivot ball, as well as receive the friction washer about the neck of the pivot ball to retain same in place. The adjustable buttstock connector has a threaded connector member emanating therefrom formed to engage the inner wall of the nut partially enveloping the pivot ball, providing pivotal engagement while engaging the buttstock connector to the ball portion of the pivot ball.

In use, the present invention allows multiple adjustments as to the position/orientation of the buttstock/butt plate to the shoulder of the user. Further, the pivot ball can be adjusted as to line-of-sight orientation of the firearm relative to the anchor point at the shoulder of the user, and either be adjusted to and fixed in a particular predetermined pivotal orientation such as, for example, via tightening the friction washer via the threaded connection of the adjustable buttstock connector with the nut.

In addition, the present application teaches a second embodiment of the invention which details a haptic feedback or detent feature associated with the ball and socket swivel connection, such via a spring-biased ball bearing emanating from the pivot ball selectively engaging one or more spaced groove(s) or detent(s) in the socket or visa-versa, which can be provided to allow the user to pivot the firearm in real time and receive positional feedback as to the firearm relative to its longitudinal axis.

The detent feature can provide a releasable resistance or locking of the swivel function associated with the pivot ball in the socket at, for example, predetermined line-of-sight alignment points of the firearm, each alignment point associated with a separate sighting device mounted to the firearm, each alignment point which can be associated with a separate sighting device mounted to the firearm, allowing the user to pivot the firearm to select the desired sighting device and receiving positive feedback as to proper alignment with the selected sighting device, all the while maintaining the buttstock securely against the shoulder of the user to maintain a firm anchor point for use. Accordingly, "haptic" references the feature whereby the user is provided physically manifested feedback during operation, in this case, in the form of resistance to further movement when swiveling the firearm with the shoulder rest in place.

This feature of the present invention is particularly suitable for use with a firearm having offset sighting apparatus such as scopes, iron sights, etc, allowing the user to swivel the firearm along its longitudinal axis in a fluid motion while maintaining stable contact with the user's shoulder. The haptic feedback or detent feature can be configured to facilitate feedback such as a point of resistance or engagement during a longitudinal pivot of the firearm where the user's line-of-sight is in alignment with a respective sight(s) on the firearm, allowing the user to pivot the firearm to releasably lock the pivot at each line-of-sight point for a respective sight on the firearm, allowing for easy, intuitive alignment of the user's line of sight with the chosen sighting apparatus. This is particularly useful for a weapon having one or more mounted offset sighting apparatus in addition to the main sight.

The present thereby provides an easily-implemented, reliable, cost effective, unique and innovative system to customize how the rear stock engages the shoulder of the user during use, while quickly and easily allowing positional of the firearm at the user's shoulder to facilitate re-adjustment to accommodate changes in operating requirements of a firearm and circumstances of use, etc, as well as providing an intuitive means of pivotally adjusting the firearm about its longitudinal axis to provide line-of-sight alignment with a desired sighting apparatus on the firearm, which can include haptic feedback as discussed herein.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 7 is a side, partial, partially cutaway of the invention of FIGS. 1-6, illustrating the adjustable buttstock shoulder rest engaging the adjustable buttstock connector via first and second fasteners and position lock plate situated at the second end of an adjustment slot formed along the length of said buttstock shoulder rest.

FIG. 8 is a side, partial, partially cutaway of the invention of FIG. 7, illustrating the adjustable buttstock shoulder rest engaging the adjustable buttstock connector via loosened first and second fasteners, and position lock plate situated about medially in said adjustment slot formed along the length of said buttstock shoulder rest.

FIG. 9 is a side, partial, partially cutaway of the invention of FIG. 8, illustrating the adjustable buttstock shoulder rest engaging the adjustable buttstock connector via first and second fasteners, and position lock plate repositioned so as to be situated towards the first end of said adjustment slot formed along the length of said buttstock shoulder rest.

DETAILED DISCUSSION OF THE INVENTION

Figure 1:
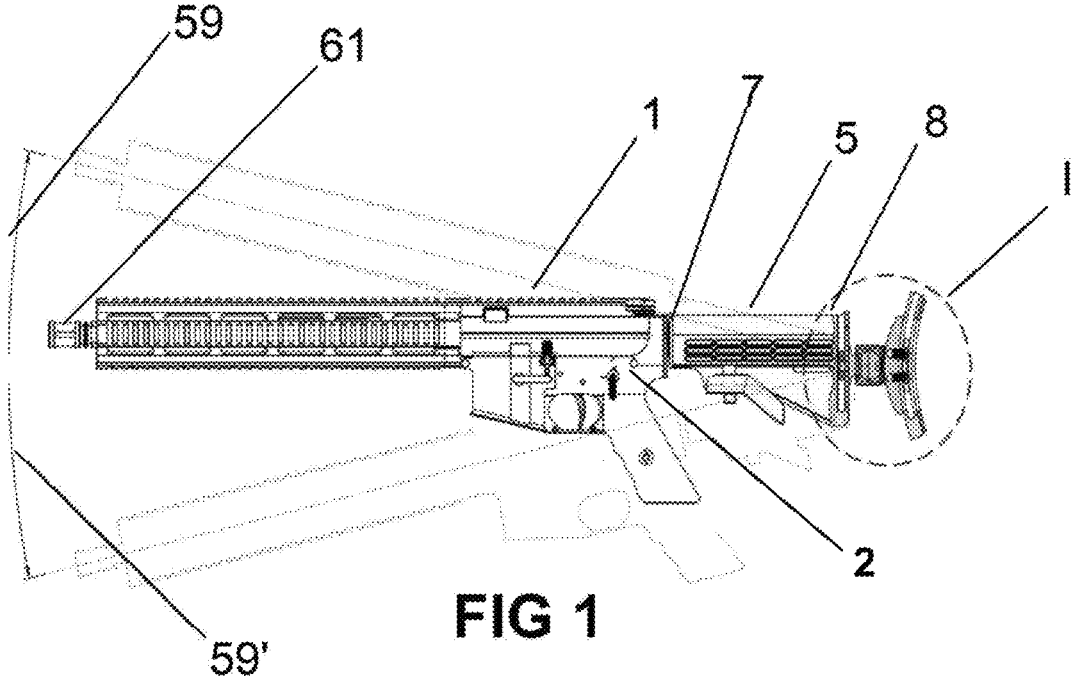
FIG. 1 is a side, partially cutaway view of an exemplary firearm having the apparatus of the first embodiment of the present invention mounted to the butt-end of the rear stock, showing the vertical range of motion afforded by the ball and socket swivel connection, in phantom.
Figure 2:
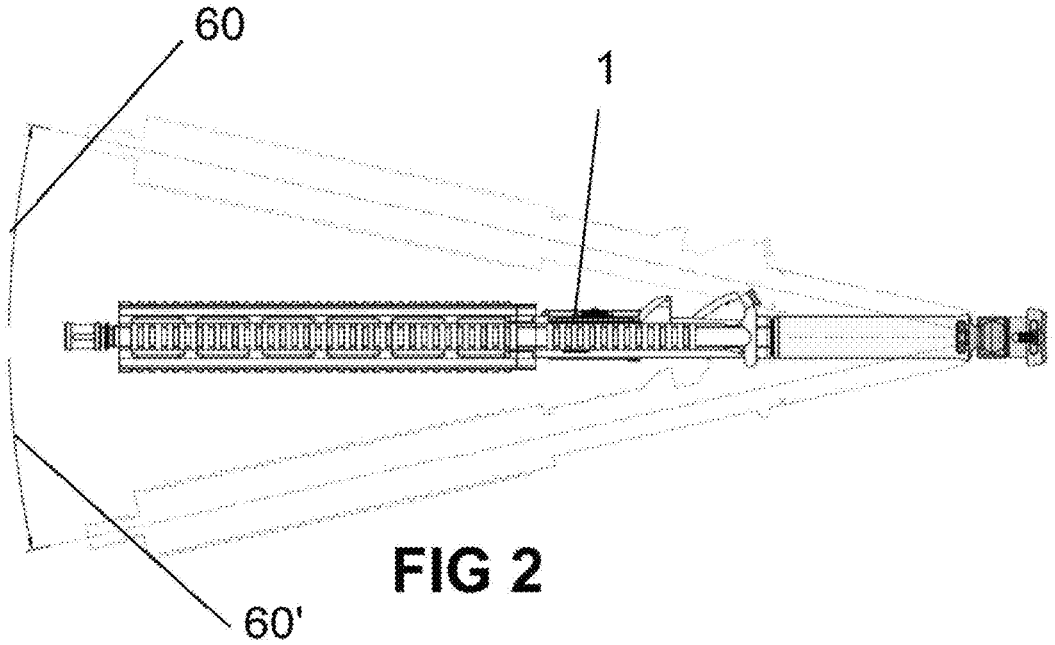
FIG. 2 is a top, partially cutaway view of the invention of FIG. 1, showing the horizontal range of motion afforded by the pivot ball retainer and slot connection forming the ball and socket swivel connection, in phantom.

Referring to FIGS. 1-9, 11-13, and 15, the preferred embodiment I of the present invention emanates from or is mounted to a stock 5 for a firearm 1 having first 6 and second 6' ends, which correspond to the butt 8 and tang 7 of the stock 5, respectively. The butt 8 of the stock 5 further has a first 5' (upper) and second 5" (lower) end corresponding to the heel 9 and toe 9' of the stock, respectively, the tang 7 engaging the receiver 2 of the firearm 1.

Continuing with Figures, situated at the butt 8 end of the stock, either integrally or as an add-on, is a ball-joint carrier 10 assembly comprising a butt plate 10' at its end, the butt plate 10' situated over the length of a first slot 11, which slot is formed in the stock (or add-on applied thereto). The slot 11 is formed to provide an outer access opening 11' near the heel 9 of the butt 8, providing a passage from the first 5' end extending therethrough to about the second 5" end of the butt 8, situated in alignment behind the butt plate 10'. An access opening could also be provided in addition to or alternatively near the toe 9' of the butt 8 of stock 5.

The butt plate 10' at the end of the stock has a formed laterally therethrough a second slot 12 medially 12' situated along its length, and has a length 13 and width 13' dimensioned to allow a threaded shaft to adjustably pass therethrough to access the first slot and slidably adjusted along its length, as will be further discussed herein.

The first slot 11 is formed to slidingly receive a ball joint retainer 14, which has a threaded passage 15 formed therethrough. A pivot ball joint 16 having base 19 with a ball 17 having a top 17" on one end, a neck 18 between the ball 17 portion and the base 19, and a threaded shaft 20 emanating from the base on the other end is provided with the threaded shaft 20 formed to pass through the second slot 12 and engage the pivot ball retainer 14 slidably situated therein via its threaded passage 15, so that the base 19 of the pivot ball joint 16 is slidably adjustable 38 along the length of the butt 8 of the stock or ball joint carrier 10 mounted thereto, depending on whether it (the ball joint carrier) is an add-on, or formed in the stock itself.

After adjusted to the desired position, the ball joint 16 can rotated so as to threadingly engage the threaded passage 15 of ball retainer 14 via hex socket 17' on the top 17" of ball 17 to tighten 39 and retain the ball joint 15 against butt plate 10' to the in the desired position along slot 12.

The ball 17 has an OD 20' formed to receive thereabout a nut 21 having an ID 22 and a length having first 23 and second 23' ends, each end forming an opening, the first end 23 of nut 21 having an inwardly projecting lip 24 around its inner circumference, the second end 23' having taper 25' in the wall thickness narrowing toward said second end 23', the nut formed to slidingly, partially envelope 24' ball 17. Further provided is a threaded area 25 along the ID 22 of the nut 21 at its second end 23'.

Figure 14:
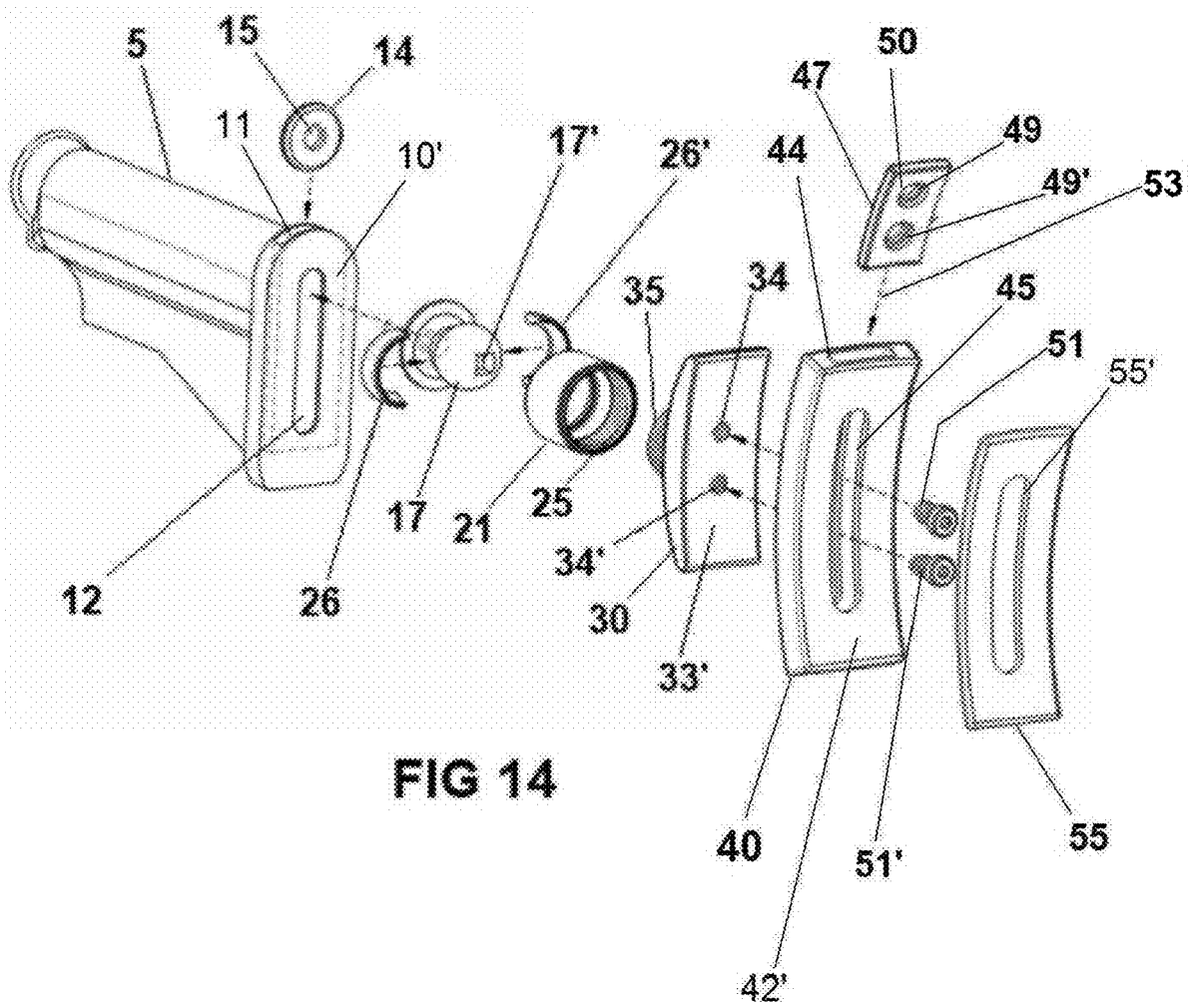
FIG. 14 is a perspective, exploded view of the invention of FIG. 12.

A friction washer F is shown split into two components 26, 26', the washer when assembled having an outer 26" diameter, an inner 27 diameter and first 27' and second 27" open ends, an edge 28 at the first 27' end and an outwardly facing radial taper 28' formed to engage the outer surface of ball 17 at the second 27" end, the friction washer situated about the neck 18 of the ball joint 16 to retain same in place (FIG. 14), with the nut 21 enveloping both the OD 26" of friction washer F,' and ball 17 of ball joint 16, with the edge 28 of friction washer which is split, comprising two components for separation during installation 26, 26' about the neck 16 of ball joint 16, then enveloped and contained by the nut which is slipped over, engaging the lip 24 of nut 21.

An adjustable buttstock connector 30 is provided having first 31 and second 31' ends and a medial area 32' therebetween, and a length 32 being radially curved 33" away from the stock 5, with a front 33 and rear 33' side.

Figure 3:
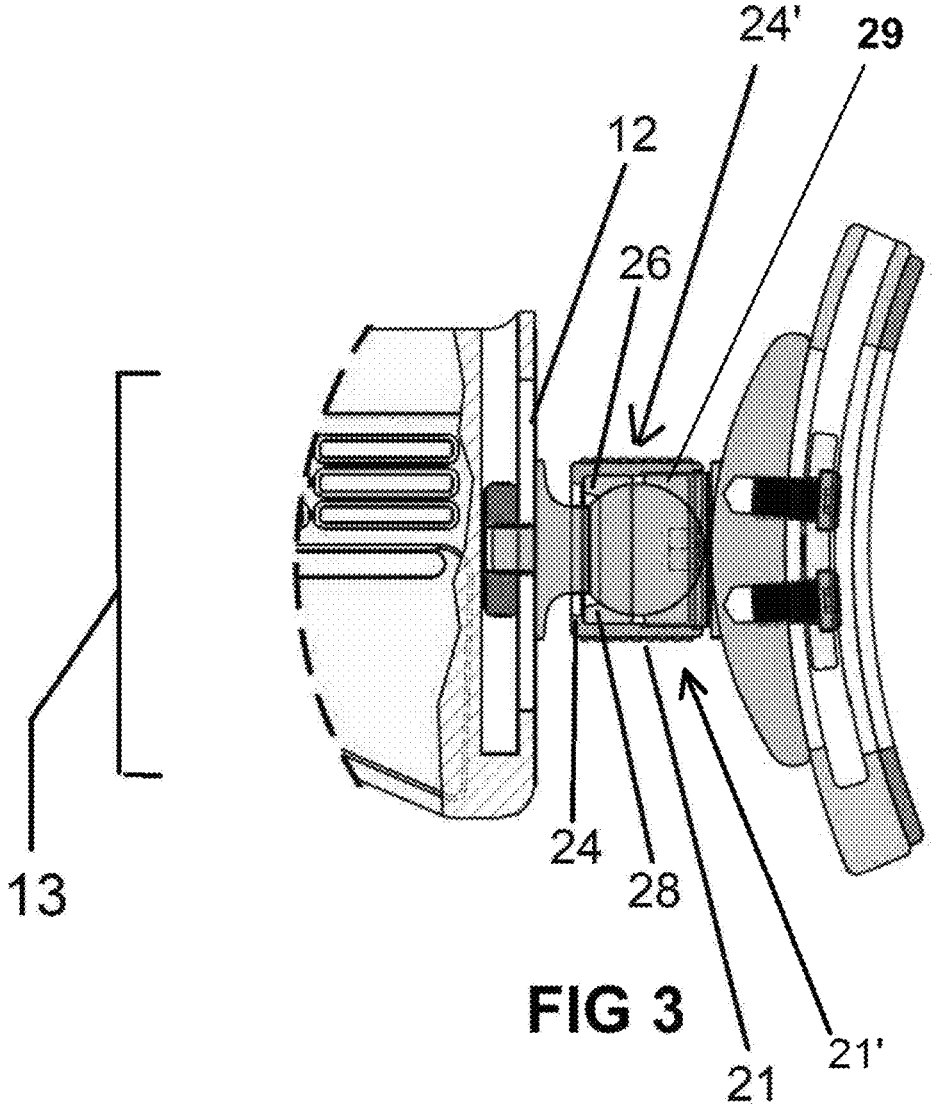
FIG. 3 is an enlarged, partial, cutaway, side view of the preferred embodiment of the apparatus of the present invention, illustrating a close-up of the various adjustable components, ball joint carrier, pivot ball and shoulder rest.
Figure 4:
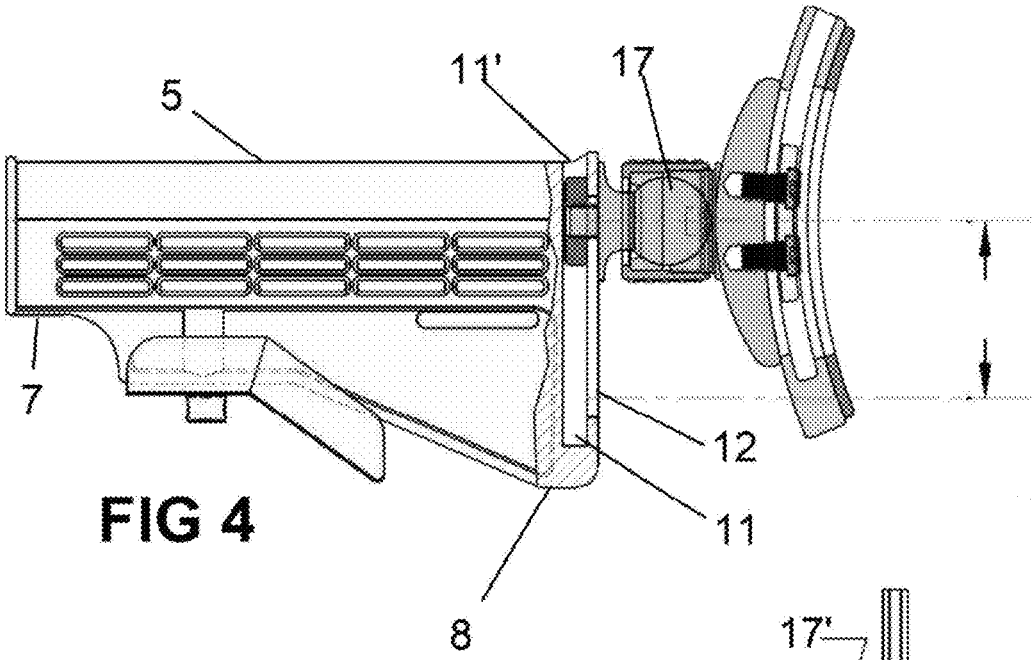
FIG. 4 is a side, partial, partially cutaway view of the invention of FIGS. 1-3, illustrating the device of the present invention mounted to an exemplary rear stock of a firearm, and illustrating the range of adjustment provided by the pivot ball retainer along a slot formed along the ball joint carrier at the butt-end of the rear-stock.
Figure 5:
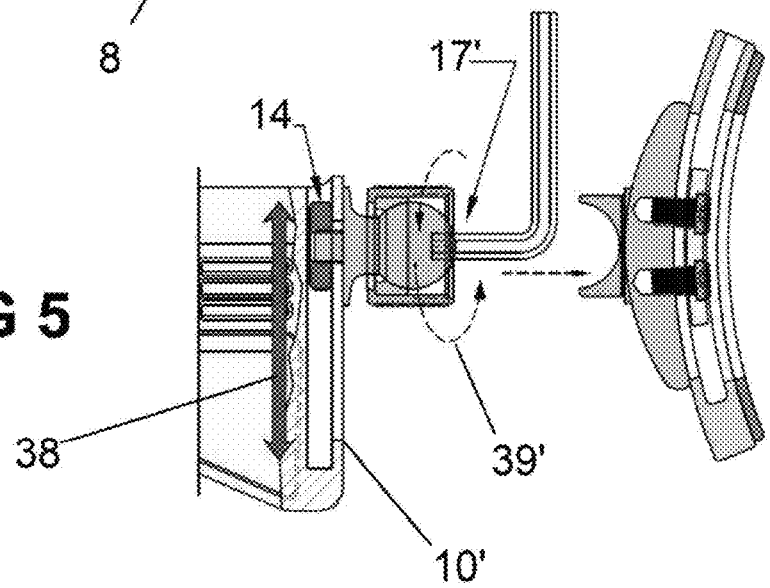
FIG. 5 is a side, partial, partially side cutaway view of the invention of FIG. 4, illustrating the loosening of the pivot ball of said slot to facilitate repositioning of the pivot ball joint retainer from a first end to a second end of said slot.
Figure 6:
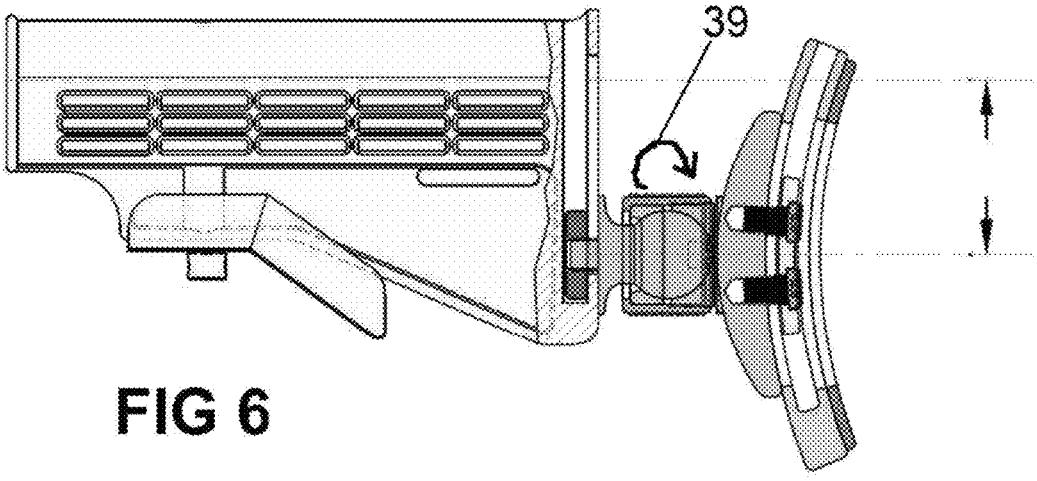
FIG. 6 is a side, partial, partially side cutaway of the invention of FIG. 5, showing the repositioned pivot ball joint retainer at said second end of said slot.
Figure 10:
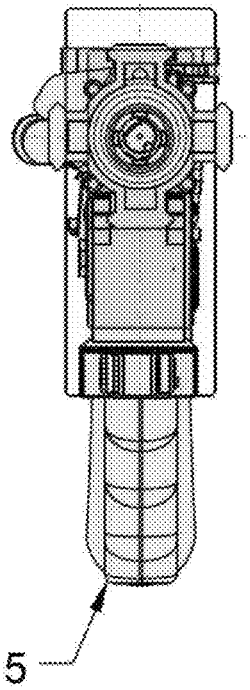
FIG. 10 is a frontal view of the barrel end of the firearm of FIG. 1 as conventionally utilized in the horizontal orientation.
Figure 11:
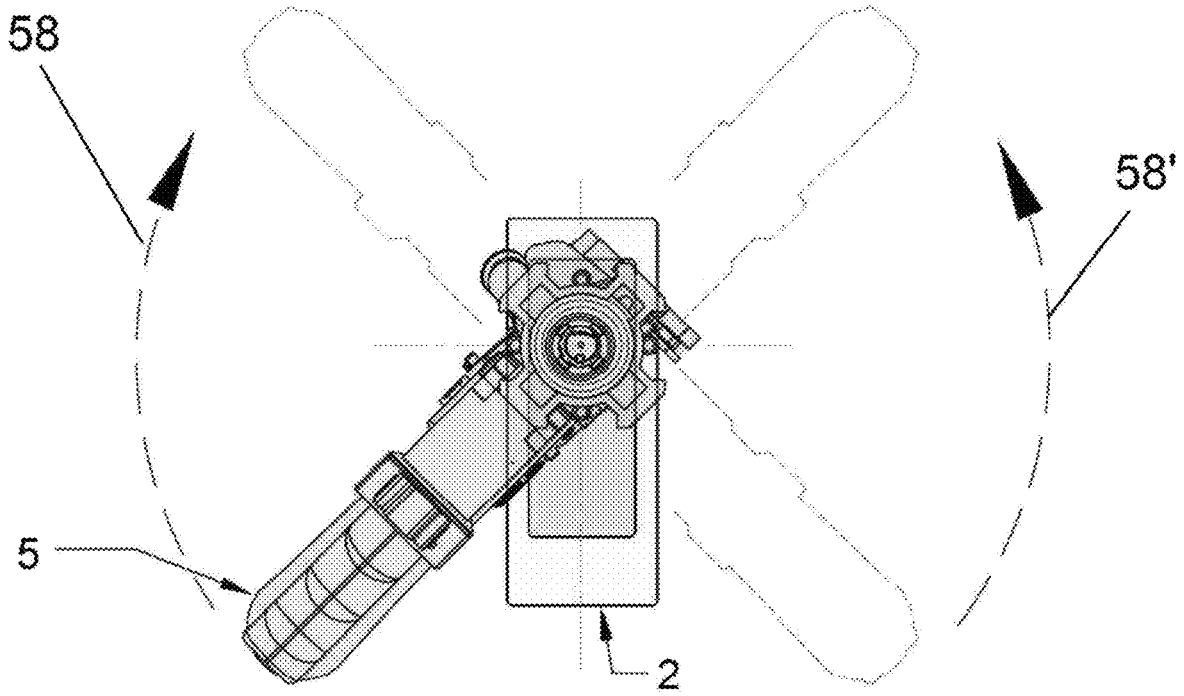
FIG. 11 is a frontal view of the invention of FIG. 1 illustrating an exemplary range of pivot provided by the ball retainer and slot connection forming the ball and socket swivel connection at the rear stock, as shown in FIGS. 1-9.
Figure 12:
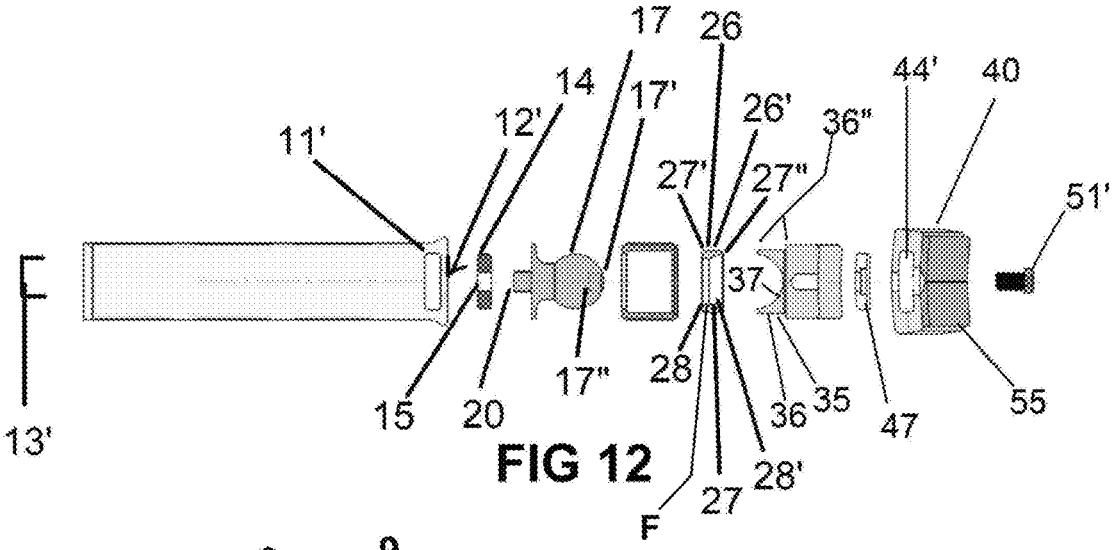
FIG. 12 is a top, exploded view of the invention of FIGS. 3-9.
Figure 13:
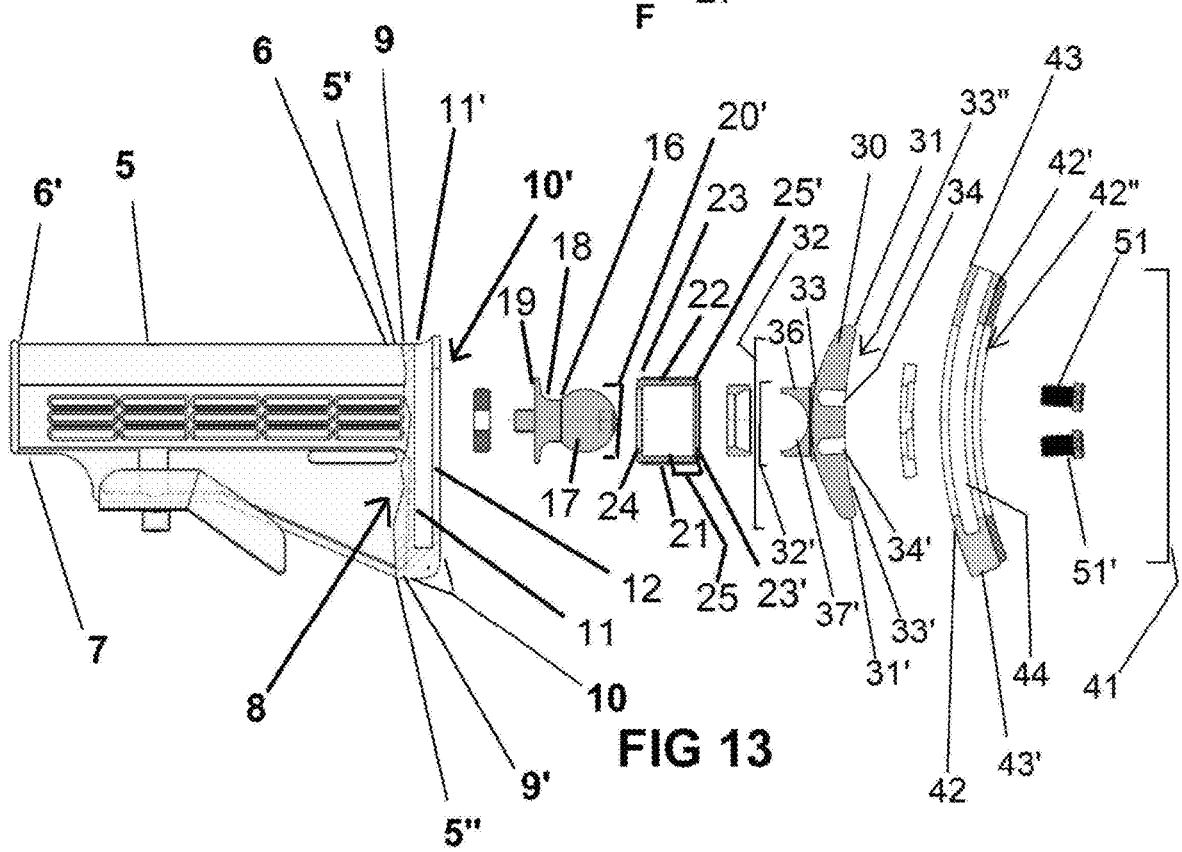
FIG. 13 is a side, exploded view of the invention of FIG. 12.

Emanating from the front 33, medial 32' area is a swivel extension 35 having a length 36" having an outer diameter (OD) 36 which is threaded 36', and a concave socket 37 formed therein having an inner wall 37' provided to engage the outer surface 29 of the top 17' of the ball 17, with the OD 36 formed to engage the threaded 25 inner diameter 25 of the nut 21 when enveloping/engaging the pivot ball (as shown in FIG. 3), providing pivotal engagement 21' (FIG. 3) which can be adjusted to a desired position (or providing a swivel connection) via loosening or tightening the threaded connection between nut 21 and swivel extension 35, the greater tightening the greater resistance to movement. Situated in the medial 32' rear 33' portion of the buttstock connector 30 are two spaced threaded passages 34, 34' for receiving threaded connectors 51, 51', as will be further discussed infra.

The final component in the preferred embodiment of the invention comprises a shoulder rest 40 having a length 41 and opposing first 42 and second 42' sides and first 43 and second 43' ends, the second side 42' formed to receive a relief pad 55 mounted thereto for contacting the shoulder of the user, the shoulder rest further comprising a first slot 44 formed along its length 41 to slidingly 53 receive a position lock plate 47 therein for adjustably mounting the shoulder rest to the buttstock connector 30, the position lock plate 47 formed to receive two fasteners 51, 51' which lengths pass through a second slot 45 formed through the first and second sides of the shoulder rest 40. First and second fasteners 51, 51' engage first 49 and second 49' countersunk 50 passages in the lock plate 47 which is shown slidably positioned in the first slot 44, respectively engaging first 34 and second 34' threaded passages in adjustable buttstock connector, respectively, so that the shoulder rest 40 is positionable (see FIGS. 7-9) vs the buttstock connector 30 via loosening 52 (such as via wrench 54) fasteners 51, 51', and sliding 53 the shoulder rest 40 along its length via the slotted connection with lock plate 47, then tightening 52' fasteners 51, 51' at the desired position 56, such as where the firearm sights are aligned with the user's line of sight to the target.

In use, continuing with FIGS. 1-15, as previously discussed, the present invention I allows multiple adjustments as to the position/orientation of the buttstock/butt plate to the shoulder of the user. The pivot ball can be adjusted so as to facilitate axial orientation 58, 58' of the firearm along its longitudinal axis relative to the user as either fixed in a particular, preferred orientation (via tightening the friction washer via the threaded connection of the adjustable buttstock connector with the nut), as well as providing an active swivel feature to allow the user to pivot the tip 61 of the firearm 1 up 59 or down 59', side 60 to side 60', or axially 58, 58' along its length, or any combination thereof, relative to the user U in real time (by loosening the friction washer at the pivot ball), while maintaining the buttstock securely against the pocket of the shoulder of the user.

The present invention is particularly suited to aid in the competition shooting, hunting, or military use of firearms, providing a stable, non-moving anchor point for the rifle (via shoulder rest 40 engaging the pocket of the shoulder S of the user U to keep line of sight 57 anchor point consistent through motion shooting and twisting of the gun in use in a variety of applications, including but not limited to improving line-of-sight aiming and target acquisition for a fixed stationary as well as moving target, or providing rapid sequential targeting in the case of multiple targets.

The use of one or more rail mounts for firearms for mounting accessories is well known, and can include such diverse configurations as the Picatinny/NATO rail (shown in FIGS. 15-17), or other mounting options such as provided by the Weaver rail, as well as, for example, ARCA, M-LOK/MOE, KEYMOD, dovetail, and other rail configurations. One or more rails can be mounted along the length of the firearm for mounting various accessories such as lasers, flashlights, supports such as bipods or monopods, carrying handles, sling mounts, various sighting options, etc. More than one rail can be mounted at, for example, 90 degrees relative to one another (as shown in the figures) on the firearm as well as other orientations including 45 degrees, for example.

Figure 15:
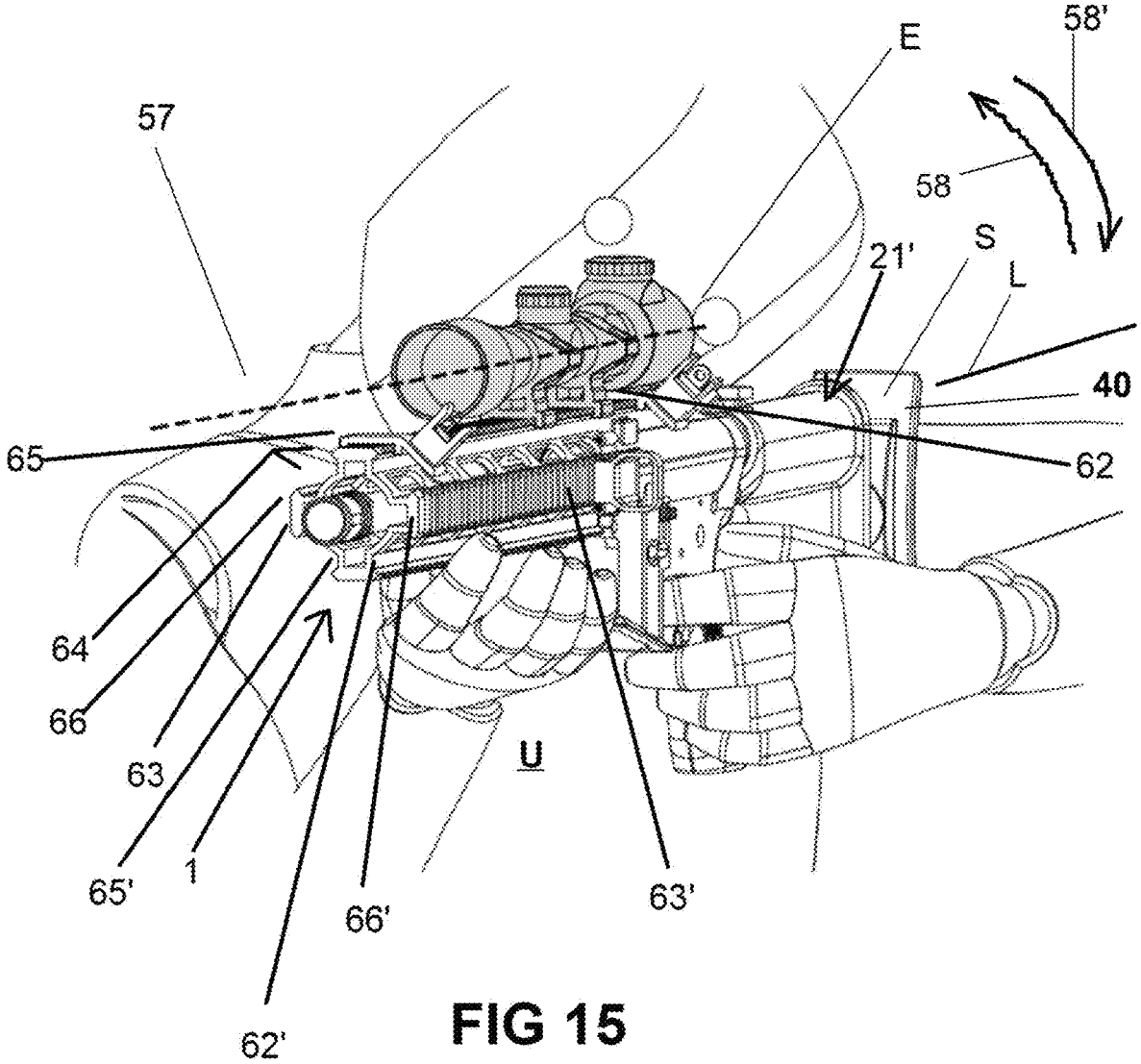
FIG. 15 is a perspective view of a user utilizing the present invention, pivotally adjusting the firearm via the ball and socket swivel at the rear stock to facilitate line of sight aiming through a scope, or telescopic sight.
Figure 16:
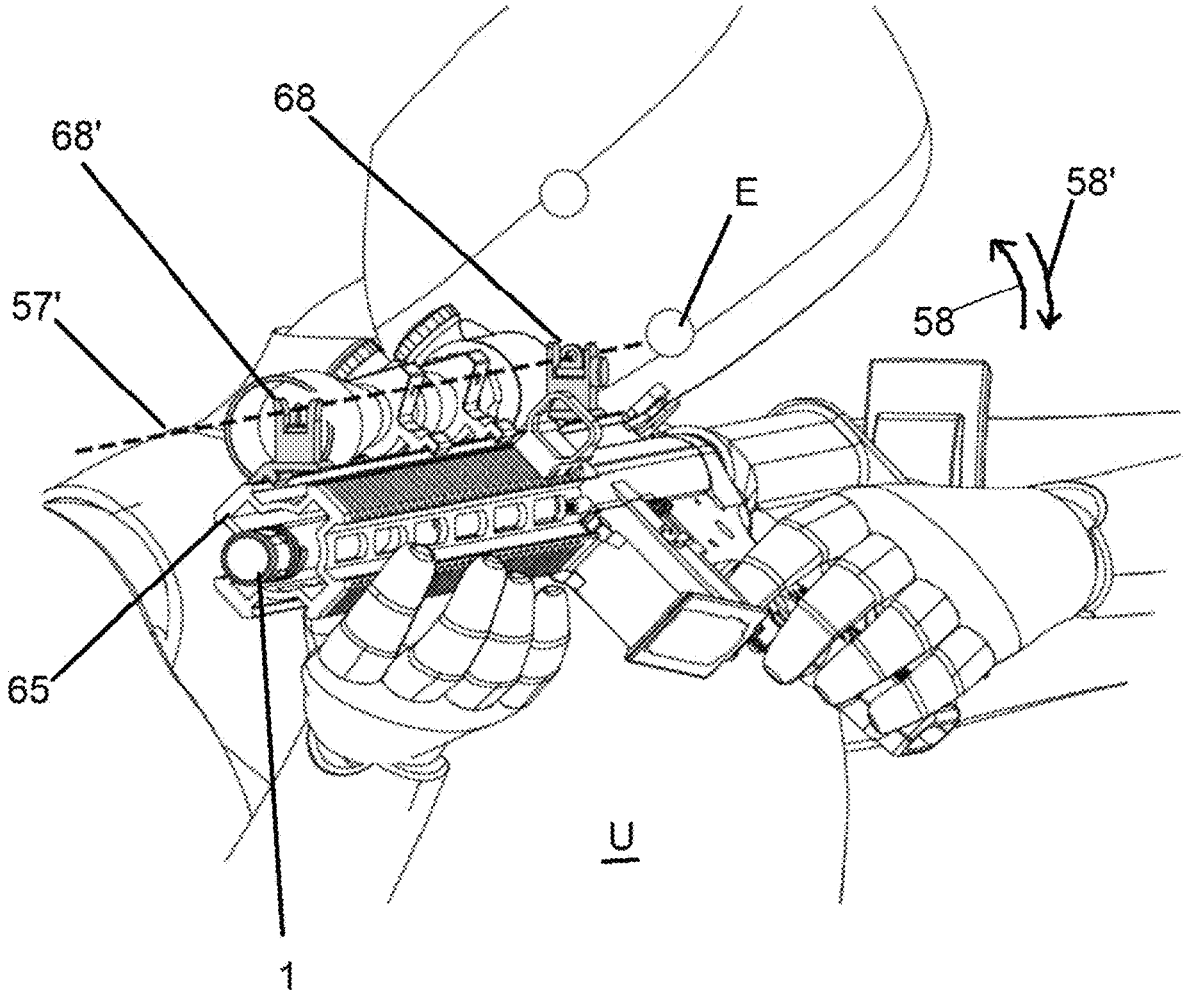
FIG. 16 is a perspective view the present invention in use, illustrating a user utilizing the invention of the present invention by pivotally adjusting the firearm to facilitate line of sight aiming via an iron sight, also known as an open sight.
Figure 17:
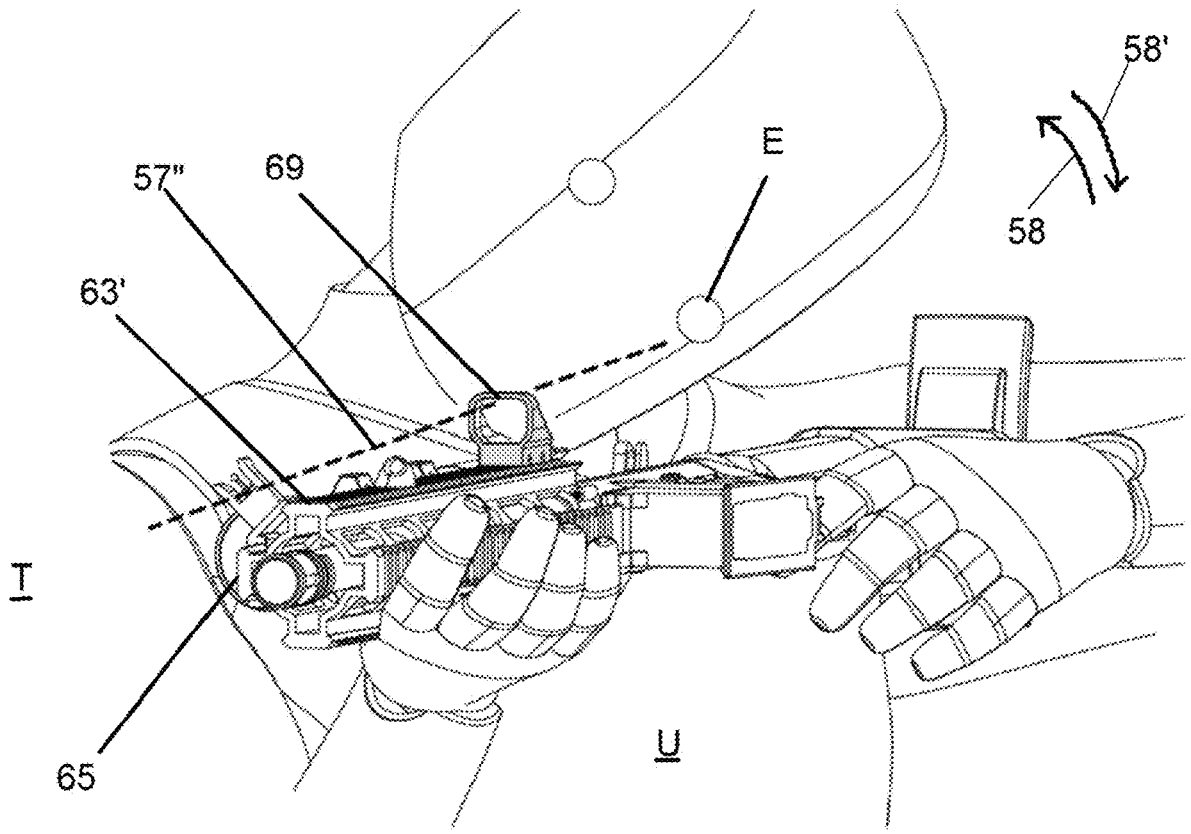
FIG. 17 is a perspective view the present invention in use, illustrating a user utilizing the invention of the present invention by pivotally adjusting the firearm to facilitate line of sight aiming via a reflex sight.
Figure 18:
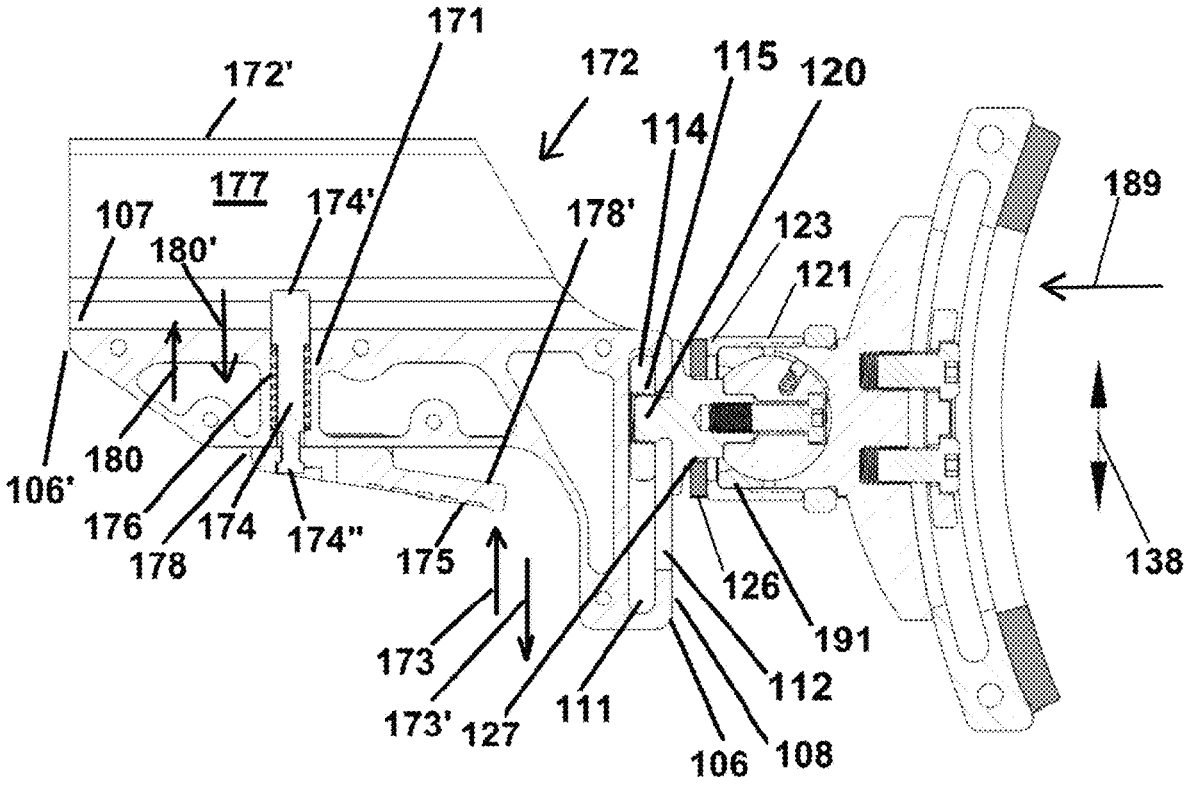
FIG. 18 is a side, partially cutaway view of a second, alternative embodiment of the invention of FIGS. 1-17, the present embodiment shown implemented with a receiver extension-mounted buttstock, the present device illustrating a slot at the end of the butt-stock having a slot formed to slidably receive the threaded base of the swivel ball (with spring biased detent bearing shown), which swivel ball engages an adjustable shoulder rest mounted thereto, the swivel ball base shown mounted at the upper, first end of the slot at the end of the buttstock.
Figure 19:
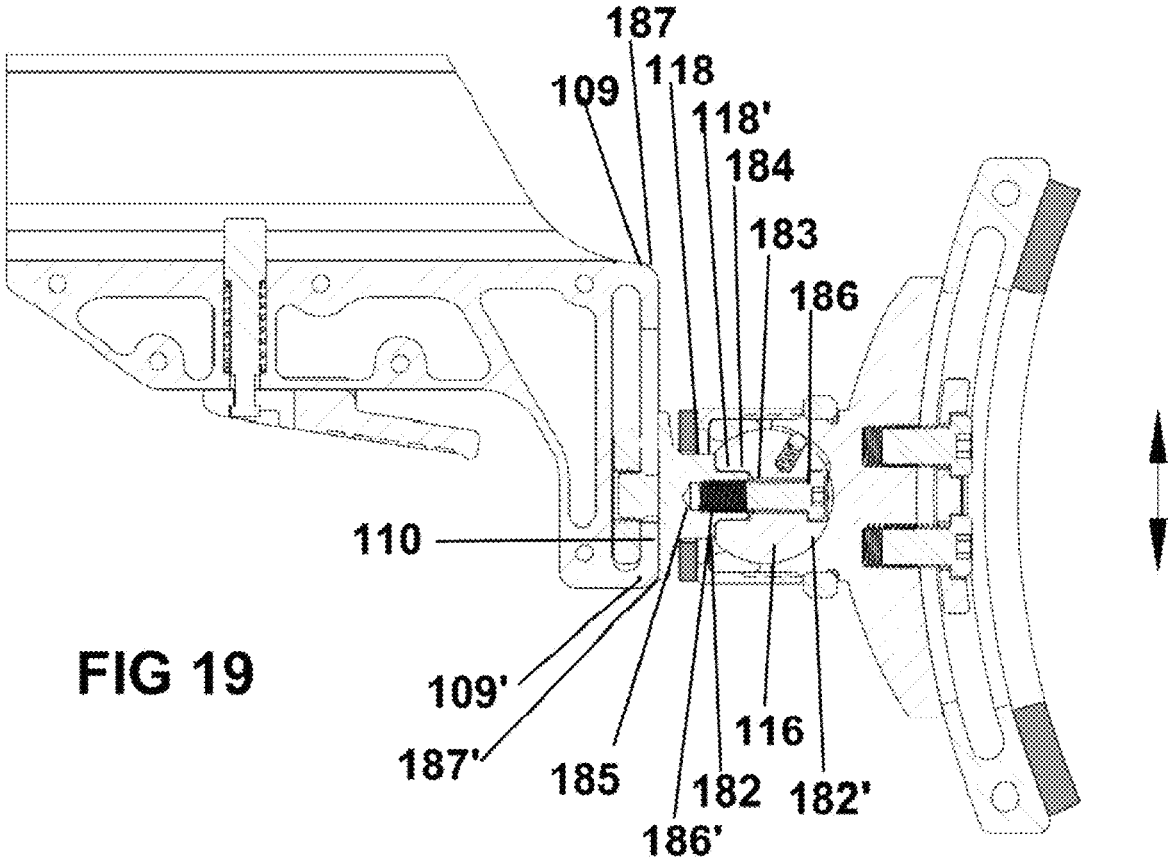
FIG. 19 is a side, partially cutaway view of the invention of FIG. 18, illustrating the split stock of the present embodiment with the swivel ball base shown mounted at the lower, second end of said slot at the end of the buttstock.

Continuing with FIGS. 15-17, the present invention provides an innovative means of accessing on demand a variety of sight options provided on the firearm via the swivel action of the present invention as needed in real time, allowing the user to select and utilize best aiming device taking into account the particular circumstances of use, target being acquired, distance, light conditions, etc.

FIGS. 15-17 illustrate a firearm 1 having top 62, bottom 62', as well as inner 63 and outer 63' side mounting rails situated at 90-degree intervals 64 along the top or upper 65, bottom or lower 65', inner 66, and outer 66' sides of the firearm 1, respectively.

FIG. 15 shows the firearm 1 situated in a horizontal shooting position with the scope situated along the upper 65 rail 62 mounted to the firearm 1. The user U positions the shoulder rest 40 in the pocket S of the shoulder, and (via swivel or pivotal connection 21'), pivots or axially orients 58, 58' the firearm along its longitudinal axis L, while positioning the eye E of the user to align with the scope to provide a line of sight 57 to the target via the scope 62, and aim the firearm accordingly.

FIG. 16 illustrates the option of an iron or open sight comprising rear 68 and front 68' sights, respectively, which are mounted to the top rail 62 of the firearm and positioned to lie at a forty-five-degree angle therefrom on the outer side of the firearm 1. Alternatively, the sight could be mounted directly to the firearm at the forty-five-degree angle via a mount, rail or the like.

In such a configuration, if the user U decides to utilize the iron or open site option, with the shoulder rest 40 in place, the firearm is pivoted to axially orient 58, 58' the firearm to position the eye E of the user in alignment with the rear 68 and front 68 iron or open sights along the line of sight 57' aligned with the target.

FIG. 17 illustrates still another example of use, wherein the option of a reflex sight 69 is provided which is shown mounted to the outer side rail 63' of the firearm, and as such is positioned to be situated along at a ninety-degree angle from on the top 65 of the firearm 1.

In such a configuration, if the user U decides to utilize the reflex site in use, with the shoulder rest 40 in place against the shoulder of the user, the firearm is pivoted to axially orient 58, 58' the firearm to position the eye E of the user in alignment with the reflex site 68 along the line of sight 57", in alignment with the target T.

Accordingly, the present invention allows a user the option of choosing from a variety of aiming options in real time by mounting an aiming option about the firearm as disclosed above, then utilizing the previously disclosed pivotal connection (21' in FIG. 3) to pivot and axially orient the firearm along its longitudinal axis to reposition the firearm to provide line-of-sight access to the desired aiming option by the user while in use.

Swivel with Detent Feature

Continuing with FIGS. 18-25 and 31, a second, alternative embodiment of Applicant's invention comprises a stock 105 formed by two halves 105', 105" split along its length and joined via fasteners 170, 170', 170" to assemble same, the stock 105 having first 106 and second 106' ends, which correspond to the butt 108 and tang 107 area of the stock 105, respectively.

An extension tube receiver 172 comprising first 172' and second 172" receiver elements is provided along the length of the assembled stock, the tube receiver having an ID 177 formed to slidingly receive and engage the firearm extension tube T, so as to facilitate adjustment of the position of the stock 105 along the length of the extension tube T.

As shown, the extension tube T is selectively adjusted 179 to the desired position along the extension tube receiver 172, and locked in place for use via spring 176 biased adjustment pin 174 having first 174' and second 174" ends. The adjustment pin 174 is formed to slidingly reciprocate in passage 171 formed in stock 105 so as to facilitate disengagement (by retracting adjusting pin 174 from extension tube T) or engagement via spring 176 urging adjustment pin 174 so that its first end 174' engages against extension tube T or into an aperture or cavity formed along the length of extension tube T) via squeezing 173 or releasing 173' pivot lever 175, respectively.

As shown, pivot lever 175 has first 178 and second 178' ends, the first end 178 pivotally engaging the second end 174" of adjustment pin 174 (such as via a self-locking nut and spring pin or the like) so that the spring 176 urges adjustment pin 174 against extension tube T and the first end 178 of pivot lever contacts stock, with the second end 178' of pivot lever 175 is spaced from the stock.

When the second end 178' is squeezed 173 or pressed against stock 105 to overcome the spring 176 bias, the second end 175' of adjustment pin 174 retracts 180 away from extension tube T, allowing adjustment 179 of the stock 105 position extension tube receiver 172 associated therewith along the extension tube T, as long as the first end of pivot lever 175 remains pressed.

Upon completion of adjustment of the stock position along the extension tube T, the first end 178' of pivot lever 175 is released 173' by the user, at which point spring 176 urges 180' the first end 174' of adjustment pin 174 to extend 180' against extension tube, locking the stock in the adjusted position.

The butt 108 of the stock 105 comprises upper 187 and lower 187' ends corresponding to the heel 109 and toe 109' of the stock, respectively.

Situated at the butt 108 end of the stock, either integrally (as shown) or alternatively as a separate add-on, is butt plate 110 (this need not be a separate plate but can be simply the end of the assembled stock as shown in the figs and as shown is formed by joining the two stock halves 105', 105"), forming the end of the stock 105 and at least partially covering an underlying a first slot 111 formed there behind.

The butt plate 110 has formed laterally therethrough a slot 112 medially 112' situated along its length, the slot having a width 113' less than that of underlying first slot 111, the slot 112 dimensioned to allow a threaded shaft 120 to pass therethrough so that its end accesses the first slot 111 to threadingly engage a lock plate 114 with threaded aperture functioning as a ball joint retainer 114 so as to be slidably adjustable along its length, as will be further discussed herein.

In the present embodiment, the ball joint retainer 114 is positioned in the first slot 111 area between the first 105' and second 105" halves forming the stock 105 prior to assembly then joined so that it is provided within the first slot 111 in the assembled stock. The first slot 111 is formed to envelope the ball joint retainer 114, which has a threaded passage 115 formed therethrough and align able with slot 112.

A base 119 for pivot ball 116 is provided which comprises a threaded shaft 120 on one end and a neck 118 with boss 118' emanating therefrom at the other end, the boss 118' formed to engage pivot ball 116 for mounting same, as will be further discussed herein.

The threaded shaft 120 is formed to pass 189 through the slot 112 in butt plate 110 to threadingly engage the pivot ball retainer 114, which is slidably situated in the first slot 111, via threaded passage 115, so that the base 119 of the pivot ball 116 is slidably adjustable 138 along the length of slot 112 via loosening and tightening the threaded connection therebetween using a wrench or the like engage flats 119' on the neck 118 of base 119 and rotating 181 same clockwise or counterclockwise, to tighten or loosen threaded shaft 120 relative to threaded passage 115 in the desired position, respectively.

Continuing with the Figures, pivot ball 116 is shown having first 182 and second 182' opposing ends with a fastener passage 183 formed therebetween, the first 182 end further having formed therein a pocket 184 to receive boss 118' so as to mount pivot ball 116 thereupon. Boss 118' has threaded passage 185 centrally situated along its length therein, positioned to align with pivot ball passage 183 when pivot ball 116 is mounted on boss 118', so that a fastener 186 can pass through ball passage 183 and threadingly engage passage 185 in boss 118' to secure pivot ball 116 in place.

Ball 116 has an OD 120' formed to receive at its first end 182 an insert 191 having a concave ID 191' so as to evenly engage the OD 120' of ball 116 where they contact, the first end 182 of ball 116 with insert 191 being situated in the ID 122 of nut 121 as shown.

Nut 121 has a length having first 123 and second 123' ends, each end forming an opening, the first end 123 of nut 121 having an inwardly projecting lip 124 around its ID 122 to secure insert 191 against ball 116, the second end 123' of nut 121 being threaded 125.

A friction washer 126 is provided having an inner diameter 127 so as to be situated about the neck 118 of the base 119, with the first end 123 of nut 121 situated thereupon so that the friction washer 126 is sandwiched between the base 119 and nut 121. The base 119, friction washer 126, and nut 121 with insert 191 are thereby stacked as shown, and secured via fastener 186 through ball 116, with ball 116 situated in nut 121 to engage insert 191, with ball pocket 184 positioned to receive boss 118', with the fastener 186 engaging threaded passage 185, such that the length of fastener is aligned with the longitudinal axis of the firearm to which the stock is mounted.

Continuing with FIGS. 20-29, an adjustable buttstock connector 130 is provided having first 131 and second 131' ends and a medial area 132' therebetween, and a length 132 preferably being radially curved 133" away from the stock 105, with a front 133 and rear 133'. Emanating from the front 133, medial 132' area of buttstock connector 130 is a swivel extension 135 having a length 136" forming a cylindrical outer diameter (OD) 136 comprising outer threads 136' situated thereabout, the OD 136 encircling a concave cavity forming a socket 137 having therein having a center axis point 128, the socket 137 forming an inner wall 137' dimensioned to evenly engage (where they contact) and partially envelope the outer surface 129 of the second end 182' of ball 116 situated within cavity 137, thereby providing a socket S receive ball 116 and provide a swivel connection therebetween.

The present embodiment has formed in the socket 137 formed to receive a portion of the outer surface of ball 116, one or more indentations, shown in the present exemplary embodiment in the form of grooves 195, 195', 195", 199, 199', each situated along radial lines emanating from the vicinity of the center axis point 128 of the socket 137, each groove shown situated at forty-five degree increments from the adjacent groove, in the present example, zero 203, forty-five 203', and ninety degrees 203", which, for example, would correspond to grooves 195, 199, 199', respectively. In the present example, zero degrees would represent a radial line aligned with the length 141 (FIG. 20) of shoulder rest 140. Each groove has a length 196 having an end 190 in the vicinity of the center point 128 or from an equidistant space from the center point 128, and running to the outer perimeter of cavity.

Each groove 195, 195', 195", 199, 199' has a width 196' and depth 196" forming a radial wall 197 running from edge 198 to edge 198', the radial wall 197 having dimensions formed to evenly engage the outer surface or OD 194' of a ball bearing 194 when in contact. The ball bearing 194 is outwardly biased 200 via helical spring 193 or the like emanating from a shaft 116' formed therein, the shaft 116' having a depth 201 and inner diameter 201' to accommodate the dimensions of the spring and OD 194' of bearing 194, with the spring 193 providing bias 200 to urge bearing 194 away from the shaft 116 and against the socket wall 137' or grooves formed therein, depending on its position.

The placement of the shaft 116' and spring 193 biased bearing 194 on the ball 116 is likewise critical in the present example to ensure proper orientation. In the present example, the shaft with spring and bearing 194 is situated at a zero-degree orientation, to correspond with groove 195 so that its intersection with groove 195 occurs when the firearm is situated in the position shown in FIG. 32, that is, aligned with the sighting device on the top mount.

It is further noted that, although the present example illustrates groove 195 and bearing 194 with shaft being at zero degrees for the above example, this placement is for exemplary purposes only. The bearing and groove can be positioned at other angles relative to the ball and socket, respectively, and provide similar effect, what is important is that the groove and bearing be positioned to intersect and engage such that the shoulder rest and firearm, respectively, are oriented in the desired position.

Figure 20:
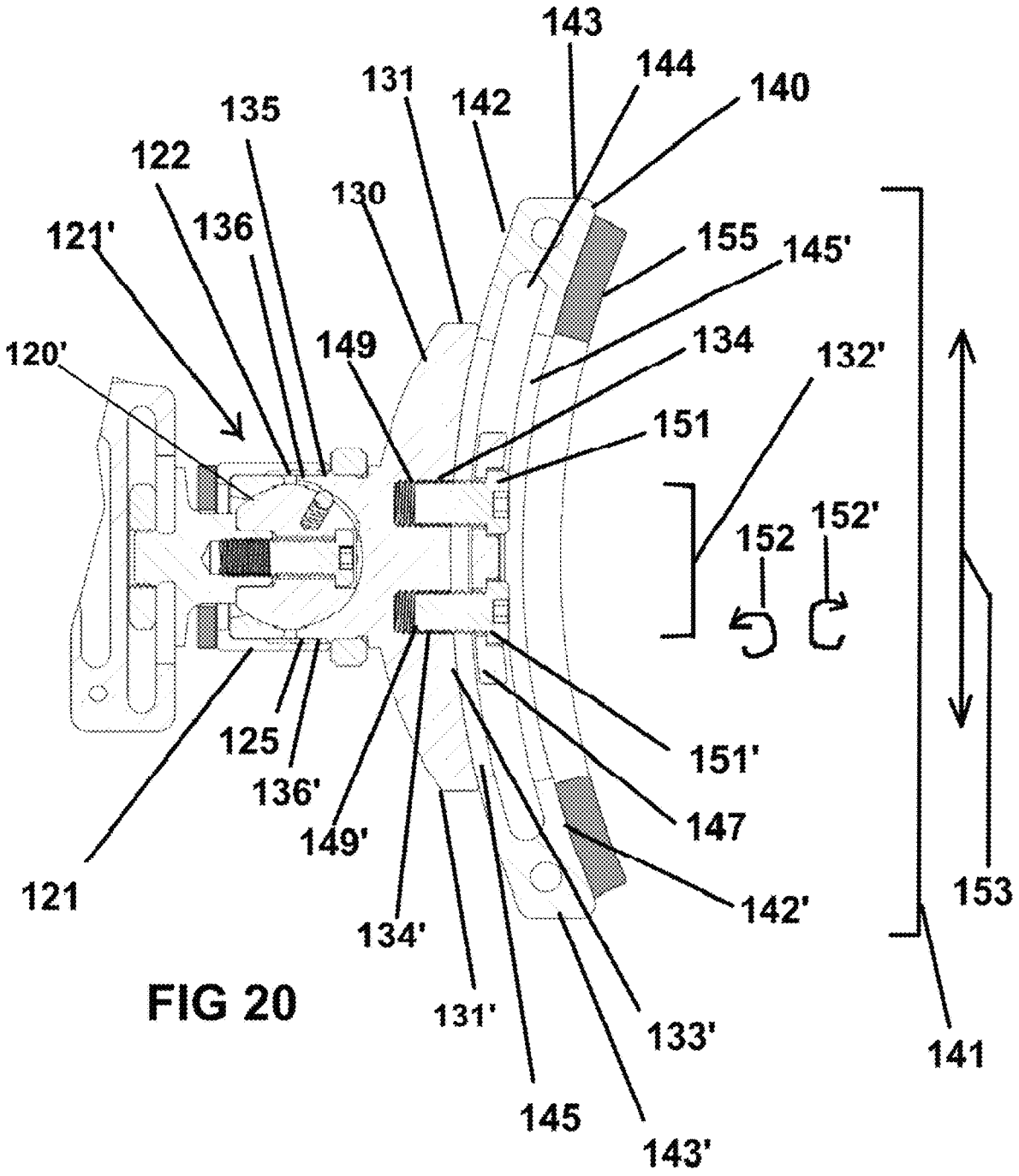
FIG. 20 is a side, partially cutaway view of the invention of FIG. 19, illustrating the pivot or swivel ball base shown mounted about medially along said slot at the end of the buttstock, and the shoulder rest supported via said swivel ball, said shoulder rest mounted via a separate slot which can be adjusted along the slot's length for repositioning same via loosening threaded fasteners to facilitate sliding adjustment along slot, then tightening to lock same in place.
Figure 21:
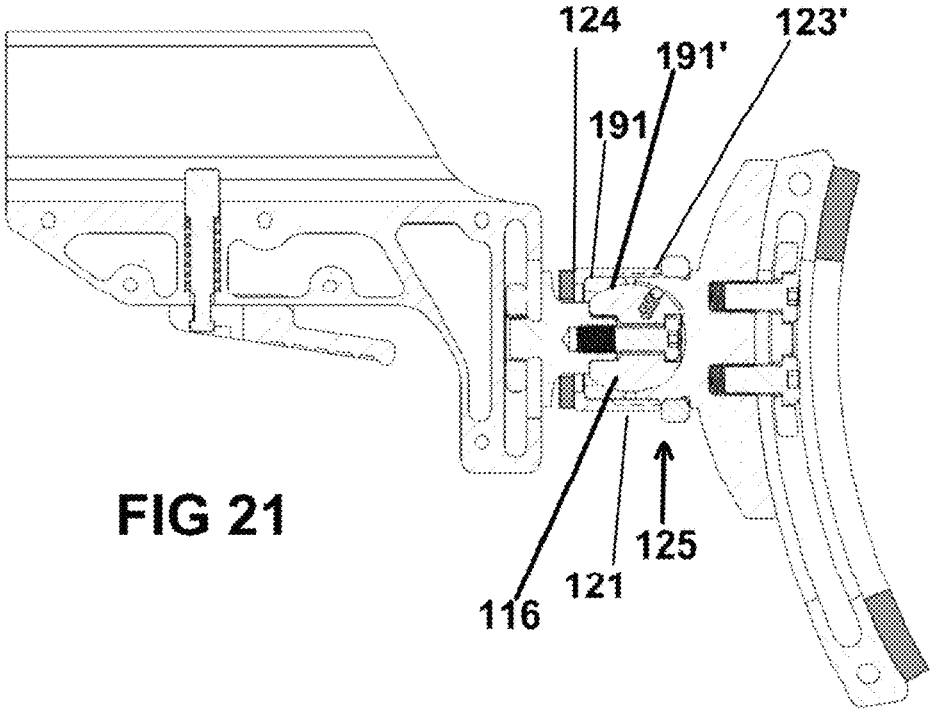
FIG. 21 is a side, partially cutaway view of the invention of FIG. 20, illustrating the swivel ball base shown mounted medially at said slot at the end of the buttstock, and the shoulder rest shown positioned at the medial portion of its mounting slot.
Figure 22:
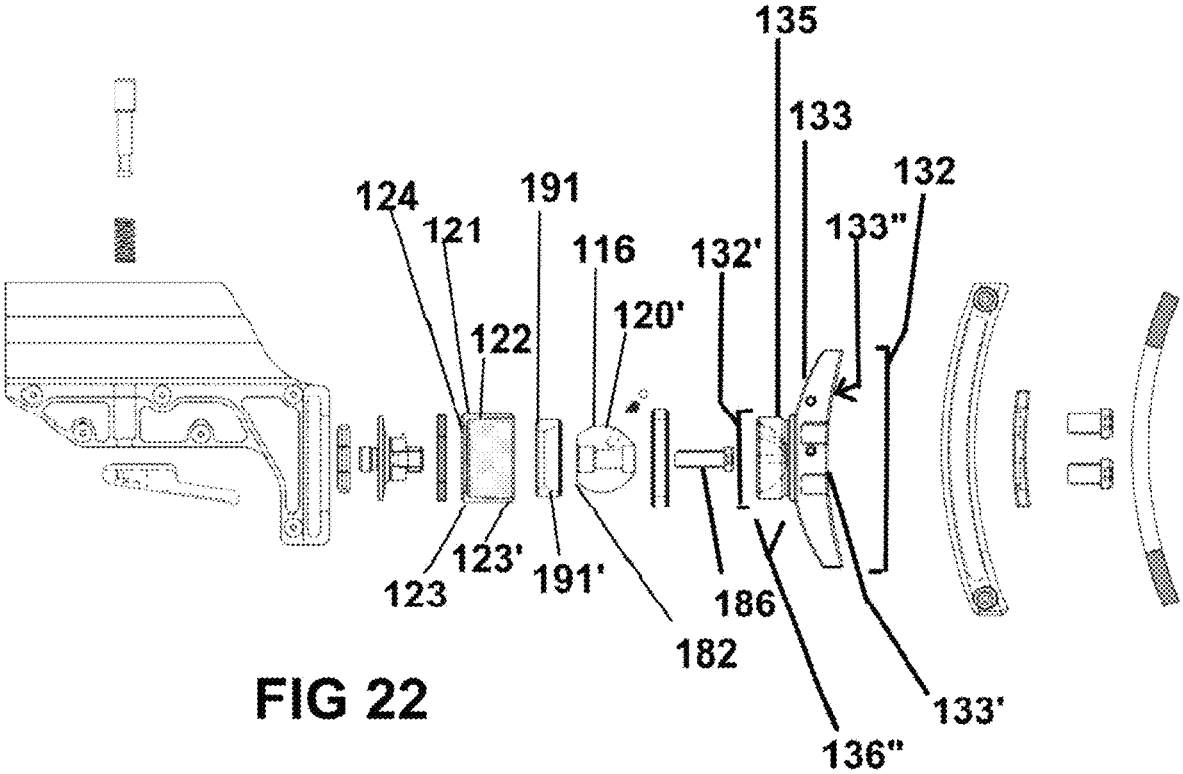
FIG. 22 is a side, partially cutaway, exploded view of the invention of FIG. 21, illustrating the various components forming the present invention, with internal structure shown in phantom.
Figure 23:
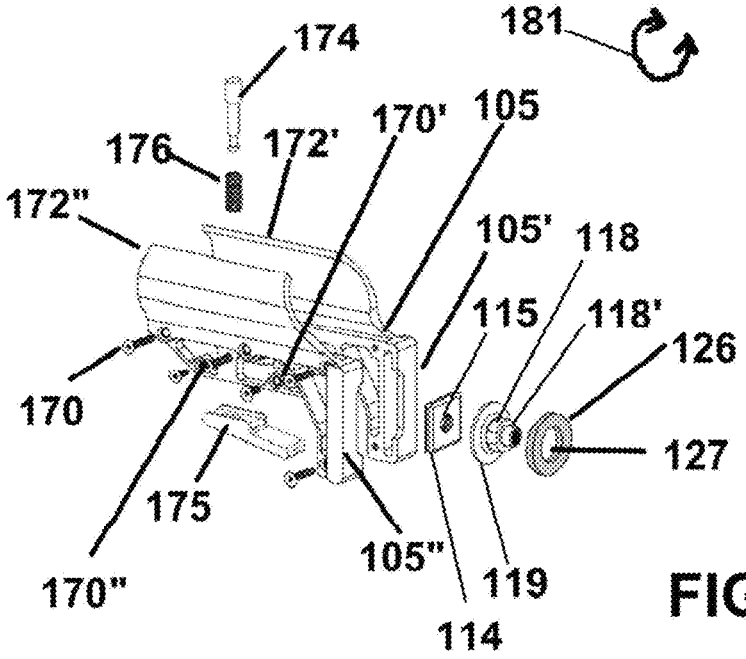
FIG. 23 is a perspective, exploded view of the invention of FIG. 22.
Figure 24:
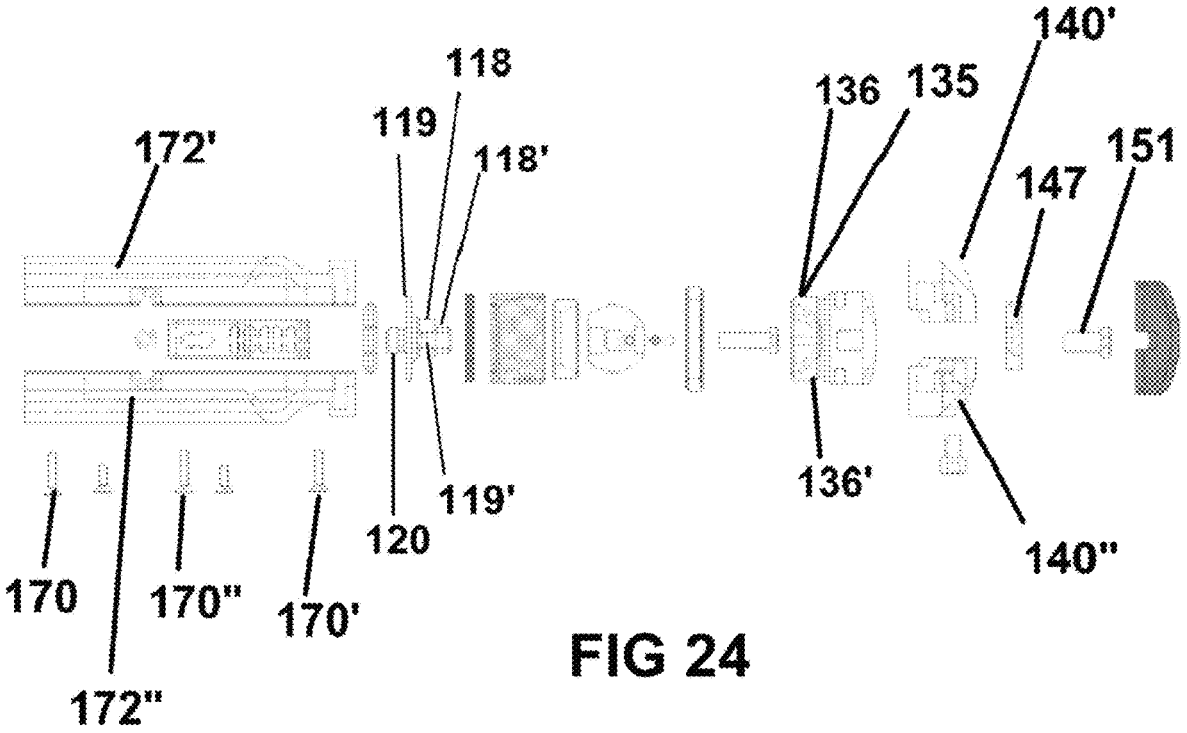
FIG. 24 is a top, exploded view of the invention of FIG. 23.
Figure 25:
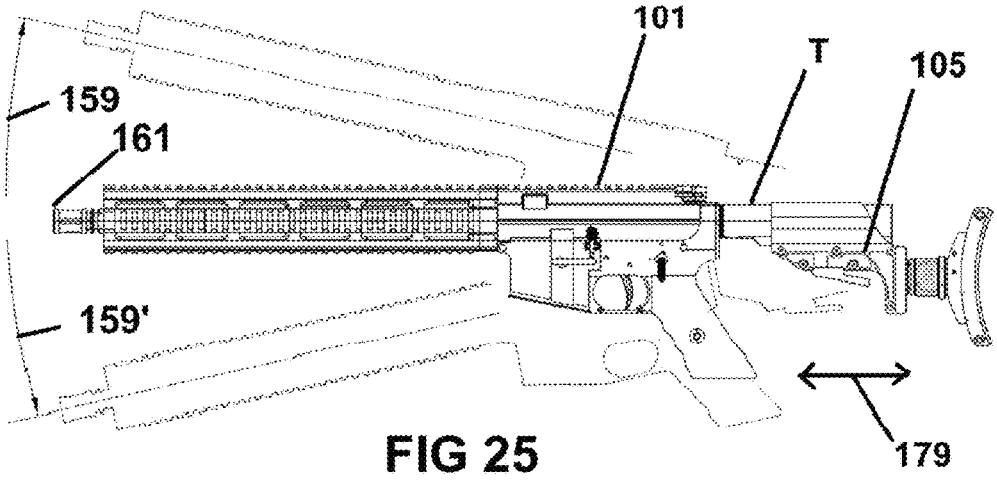
FIG. 25 is a side, partially cutaway view of an exemplary firearm having the apparatus of the invention of FIGS. 18-24 mounted thereto, showing the vertical range of motion afforded by the ball and socket swivel connection, in phantom.
Figure 26:
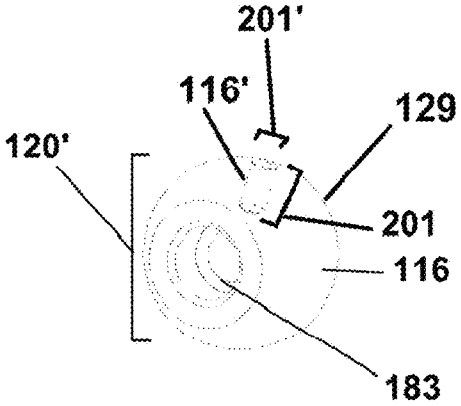
FIG. 26 is a perspective, partial cutaway view of swivel ball of the invention of FIGS. 18-24, illustrating a chamber formed in the swivel ball for receiving a detent spring and ball bearing feature, and fastener passage for mounting said ball to its base, as will be more fully disclosed herein.

Continuing with the Figures, the threaded 136' OD 136 of the swivel extension 135 is formed to engage the threaded 125 inner diameter 122 of nut 121 to secure and envelope/engage the pivot ball (as shown in FIG. 20), facilitating pivotal or swivel engagement and providing a ball and socket swivel or pivotal connection 121' which may be adjusted to a desired position via loosening or tightening the threaded connection between nut 121 and swivel extension 135 increasing or decreasing the tension therein, such that the greater tightening, the greater tension on the ball, increasing resistance. To secure the swivel engagement to a desired tension, lock Nut 202 is provided having an ID 202' to engage the ID of swivel extension 135 and nut 121 to secure the swivel engagement to the desired setting.

In using the present invention, (as will be further discussed herein) repositioning (i.e., via swiveling or pivoting the firearm vs the shoulder rest) of the ball 116 within socket 137 repositions bearing 194 within socket 137.

When bearing 194 encounters a groove formed in socket 137 (for example, groove 195 which is situated at a zero-degree 203 position in socket 137), the spring-loaded bearing provide bias 200 urging bearing 194 against the radial wall 197 of groove 195, engaging same and providing in effect a detent feature while providing feedback in the form of the user encountering a sudden resistance to movement due to the engagement of the bearing 194 with the groove.

This feedback can be used to alert and/or confirm to a user the angular position (as determined by the angle of the groove in socket) associated with the swivel connection of the ball 116 (which is fixedly engaged to the butt 108 of the firearm so this can confirm the angular position of the firearm) relative to the socket S (which is fixedly engaged to the shoulder rest 140), which in the case of groove 195, would indicate a zero-degree 203 position.

Figure 27:
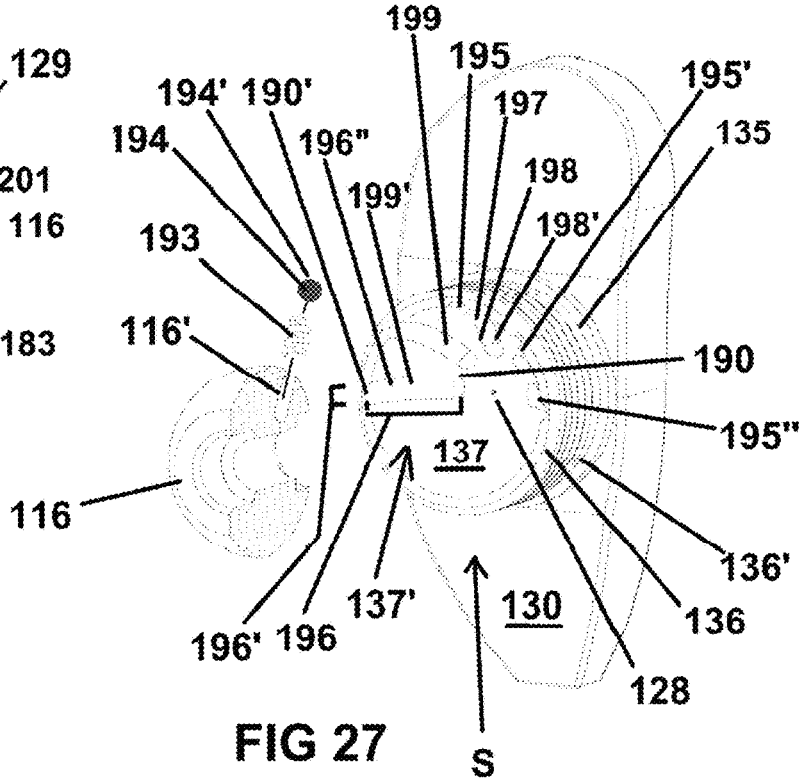
FIG. 27 is a side, partial, cutaway of the swivel ball and socket connection of the invention of FIGS. 18-26, further illustrating the swivel ball positioned for engagement with chamber for receiving a detent spring and ball bearing to provide a spring biased ball bearing formed to selectively engage one or more grooves formed in the swivel ball socket, to aid in proper line-of-sight alignment of offset sights mounted to the firearm.
Figure 28:
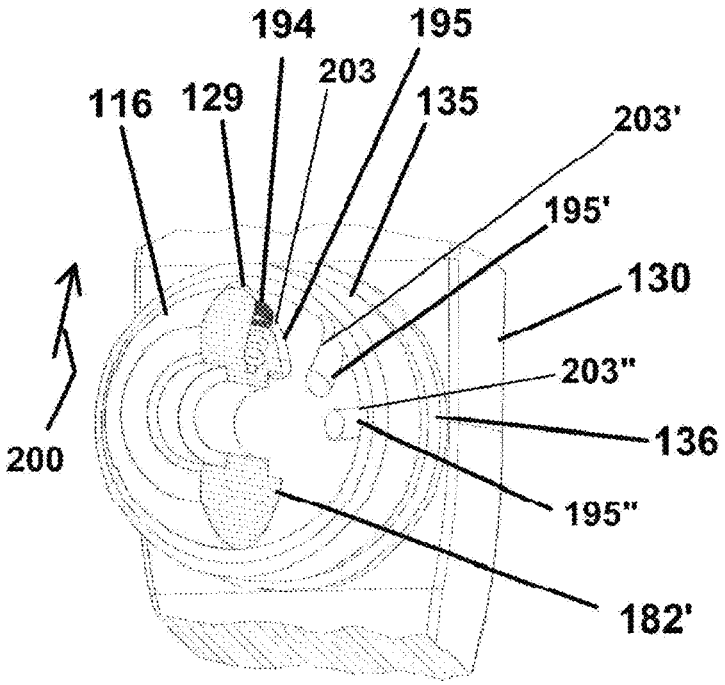
FIG. 28 is a side, partially cutaway, partially cross-sectional view of the invention of FIG. 27, illustrating the swivel ball (in cutaway) in engagement with the swivel ball socket, and spring-biased ball bearing of the swivel ball extended from the bearing shaft to engage a first groove formed therein.
Figure 29:
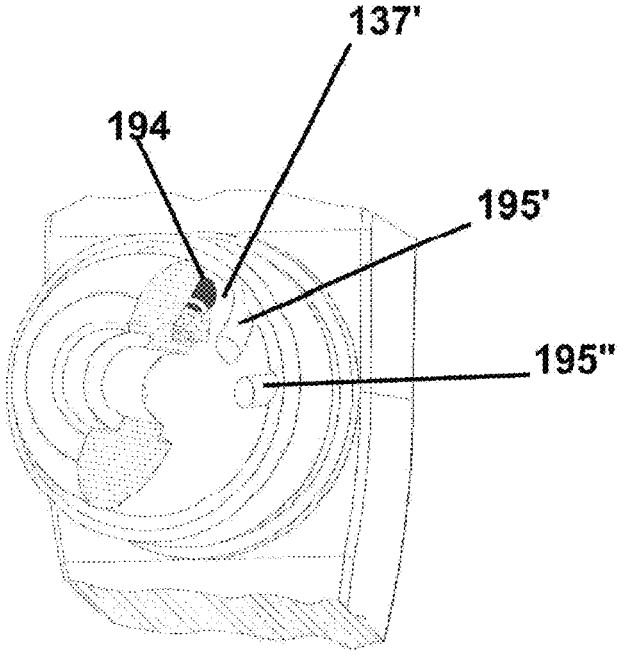
FIG. 29 is a side, partially cutaway, partially cross-sectional view of the invention of FIG. 28, illustrating the biased ball bearing of the swivel ball retracted into the bearing shaft, and situated between the first and second groove formed in the swivel ball socket of FIG. 29.
Figure 30:
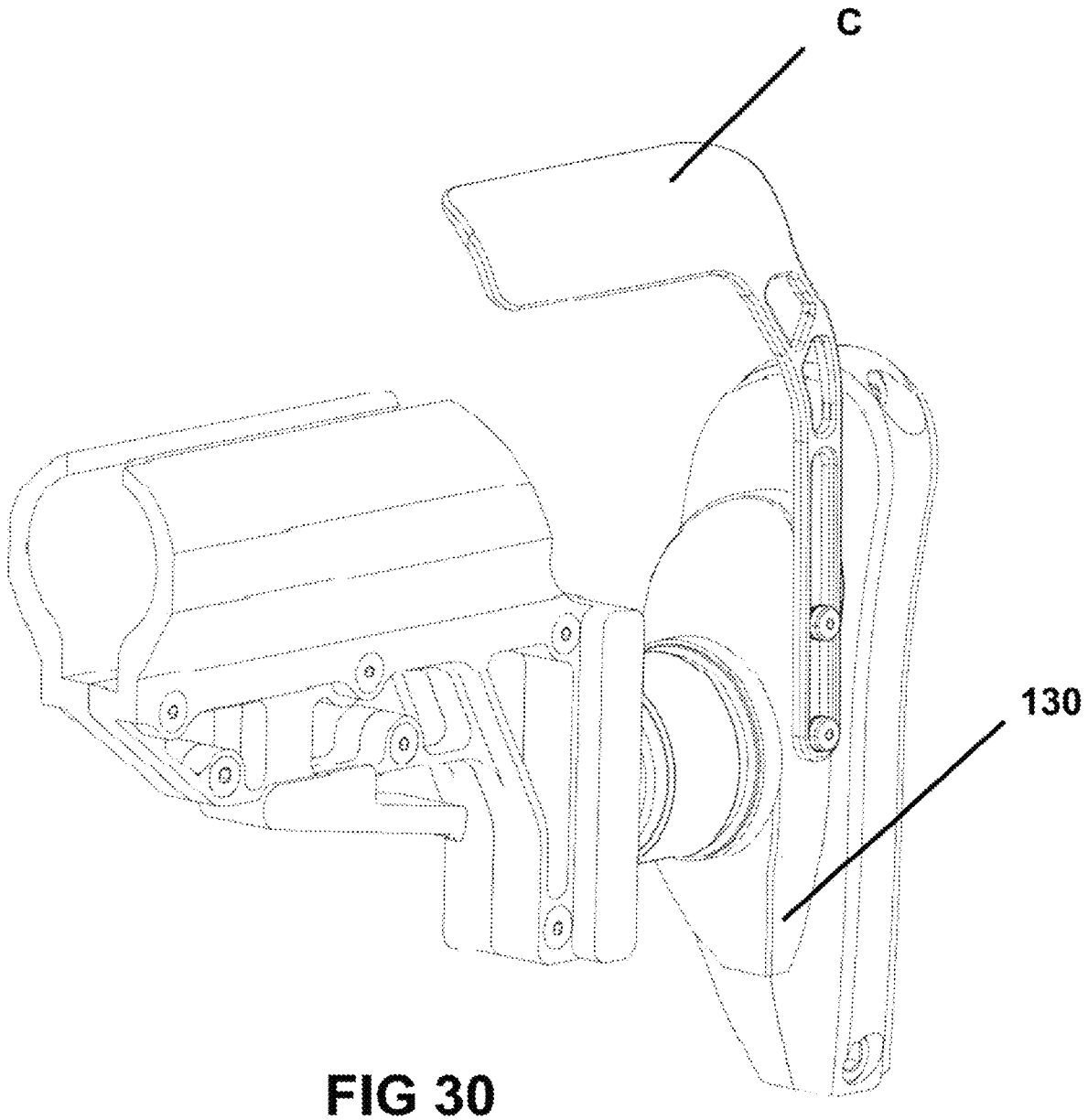
FIG. 30 is a perspective view of the present invention, illustrating a cheek rest feature mounted thereto to provide further stabilization during operation of the firearm.

This can be particularly useful where each groove is situated incrementally relative one another to correlate with a respective mounted sighting apparatus to the firearm, that is, where each groove reflects an angular line-of-sight alignment position with a respective site mounted to the firearm (in this case, in 45-degree increments), as shown the example illustrated in FIGS. 32-34 taking into account FIGS. 27-29, and as will be discussed further herein.

Continuing with the shoulder rest area of the stock, situated in the medial 132' rear 133' portion of the buttstock connector 130 are two spaced threaded passages 134, 134' for receiving threaded connectors 151, 151', respectively, for mounting the shoulder rest to the buttstock connector, as will be further discussed infra.

The shoulder rest 140 has a length 141 and opposing first 142 and second 142' sides and first 143 and second 143' ends, the second side 142' formed to receive a relief pad 155 mounted thereto for contacting the shoulder of the user, the shoulder rest formed of two components 140', 140" split along their length and joined via a fastener or the like to provide the shoulder rest 140 as single unit, the shoulder rest having a first slot 144 formed along its length 141 to slidingly 152 receive a position lock plate 147 therein for adjustably mounting the shoulder rest to the buttstock connector 130, the position lock plate 147 having first and second passages to receive first and second fasteners 151, 151', respectively, each fastener having threaded lengths to pass through second slot 145, 145' formed through the first 142 and second 142' sides of the shoulder rest 140, respectively.

First and second fasteners 151, 151' engage first 149 and second 149' countersunk passages in the lock plate 147 which is shown slidably positioned in the first slot 144, respectively engaging first 134 and second 134' threaded passages in adjustable buttstock connector, respectively, so that the shoulder rest 140 is position able vs the buttstock connector 130 via loosening 152 (such as via allen wrench or the like) fasteners 151, 151', and sliding 153 the shoulder rest 140 along its length via the slotted connection with lock plate 147, then tightening 152' fasteners 151, 151' at the desired position.

In use, continuing with FIGS. 26-29 and 32-34, the shoulder rest, being situated against the shoulder of the user, is in a relatively static position. In the present invention, with the ball and socket connection between the shoulder rest and the buttstock, the user will pivot the firearm while the shoulder rest remains relatively static in position during use.

The present invention utilizes this characteristic to provide a detent feature whereby the spring-biased bearing in the ball, forming the first component of the detent feature, is formed to engage the groove(s) formed in the socket, forming the second component in the detent feature, to provide a form of haptic feedback to alert the user as to the optimal alignment of the one or more sighting devices mounted to the firearm, as those grooves are positioned in relation to the bearing location to correlate with the location of a sighting device mounted to the firearm, or the mount associated therewith.

In such a use, when the user pivots or axially rotates 158, 158' the firearm 101, the ball 116 is likewise repositioned in the socket 137 (as the socket remains basically stationary as it is affixed to the shoulder rest engaging the user). During such movement of the ball 116 within socket 137, the spring 193 biased 200 ball bearing 194 emanating from the pivot ball 116 will engage any groove (for example, groove 195) it encounters during such positioning, providing a releasable resistance of the swivel function at that point of engagement. This point of engagement can be correlated to a predetermined line-of-sight alignment point for the firearm vis a vis the shoulder rest (in the case of ball bearing 195 engaging groove 195 in the present example both being positioned at zero degrees relative the ball 116 and socket 137, respectively, this would position the firearm at zero degrees), each alignment point associated with a sighting device mounted to the firearm.

This allows the user to pivot the firearm relative to the shoulder rest, to select the desired sighting device and receiving positive feedback (via the bearing in the ball engaging the grooves in the socket) as to proper alignment with the selected sighting device, all the while maintaining the buttstock securely against the shoulder of the user to maintain a firm anchor point.

It is noted that, while the present invention illustrates the use of a biased ball bearing emanating from the ball engaging one or more radial grooves in the socket, such an arrangement could be reversed, i.e., a biased ball bearing emanating from a shaft in the socket used to engage one or more properly positioned grooves along the ball, with similar operational characteristics.

The present invention is particularly suited to aid in the competition shooting, hunting, or military use of firearms, providing a stable anchor point for the rifle (via shoulder rest 140 engaging the pocket of the shoulder S of the user U) to maintain line of sight 157 anchor point consistent through motion shooting and twisting of the gun in use in a variety of applications, including but not limited to improving line-of-sight aiming and target acquisition on a firearm having more than one sighting device mounted thereto.

As with the first disclosed embodiment, one or more rail mounts (shown as top 162, bottom 162', and opposing side 163, 163' mounts) can be mounted along the length of the firearm for mounting various accessories such as lasers, flashlights, supports such as bipods or monopods, carrying handles, sling mounts, various sighting options, etc. More than one rail can be mounted at, for example, 90 degrees relative to one another (as shown in the figures) on the firearm as well as other orientations including 45 degrees, for example.

Continuing with the figures, a firearm 101 is provided having top 162, bottom 162', as well as inner 163 and outer 163' side mounting rails situated at 90-degree intervals 164 along the top or upper 165, bottom or lower 165', inner 166, and outer 166' sides of the firearm 101, respectively.

Figure 32:
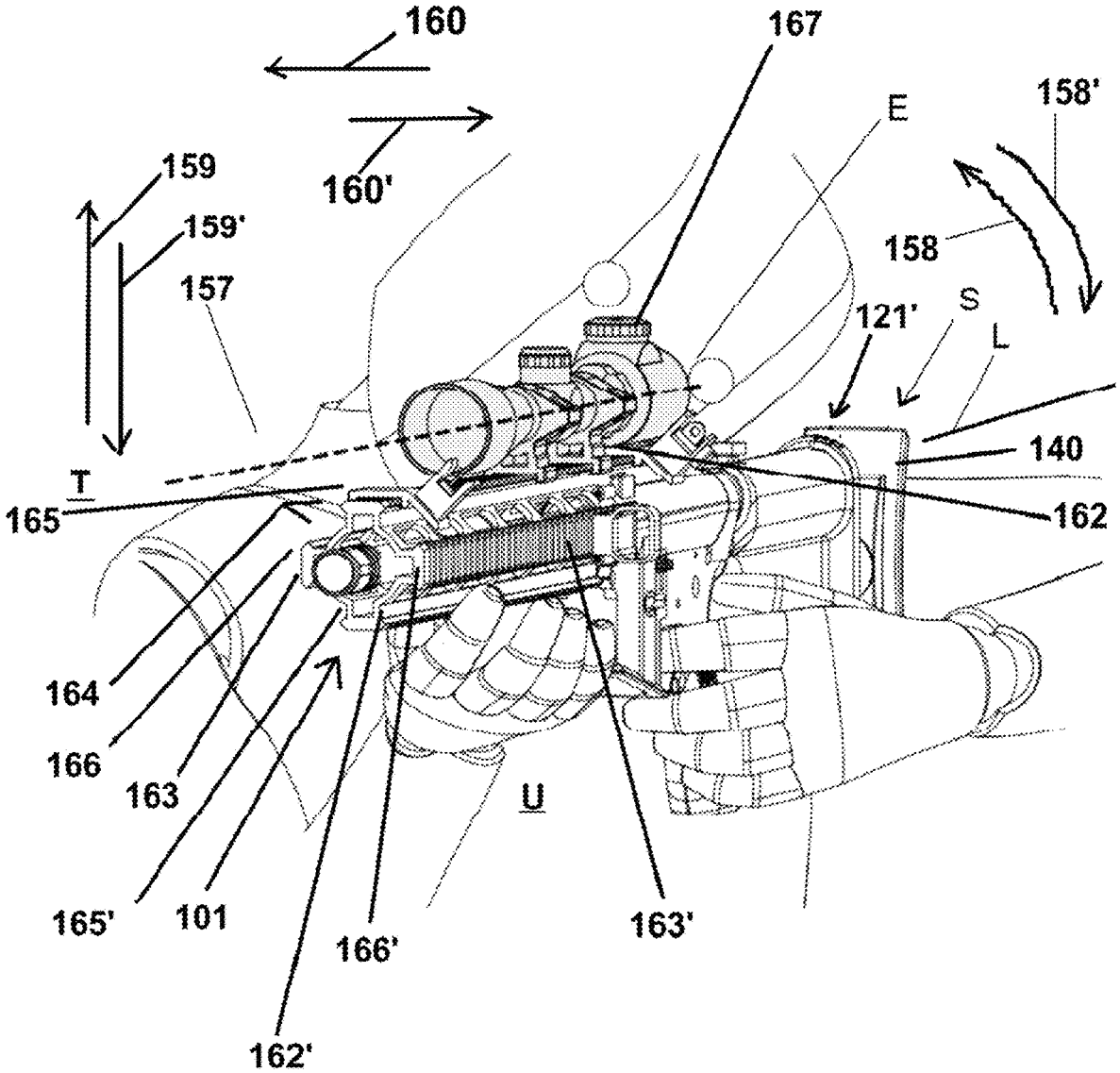
FIG. 32 is a perspective view of an exemplary user utilizing the second embodiment of the present invention, pivotally adjusting the firearm via the ball and socket swivel at the rear stock to facilitate line of sight aiming through a scope, or telescopic sight, situated along the top mount of the firearm.

FIG. 32 shows the firearm 101 situated in a horizontal shooting position with the scope situated along the upper 165 rail 162 mounted to the firearm 101. In use, continuing with FIGS. 32 and 29, the user U positions the shoulder rest 140 in the pocket of the shoulder, and pivots or axially orients 158, 158' (utilizing the swivel connection 121' provided via ball 116 and socket 137) the firearm along its longitudinal axis L. This repositions ball 116 in socket 137, so that, when the spring-biased ball bearing 184 engages groove 194, the user encounters resistance to further axial movement at zero degrees 203 due to spring biased bearing 194 engaging socket 194 (which is situated at zero degrees 203), placing the scope 167 at zero degrees and providing user with a line of sight 157 to the target via scope 167 and aim the firearm accordingly. It is noted that zero degrees is used only as an example of optimal orientation for line-of-sight and this can vary depending on the user's preferences and position.

It is further noted that, with the bearing and groove intersecting at zero degrees for placement of the firearm as shown in FIG. 32, with the groove situated at zero degrees in alignment with the length of shoulder rest as earlier referenced.

Accordingly, in the present example, if the length of the shoulder rest is situated in a vertical position, and the groove 194 is situated in alignment with the length of shoulder rest at zero degrees, the firearm 101 can be pivoted up 159 or down 159' vertically relative to the shoulder rest, and the bearing 185 will traverse along the length of groove accordingly, while resisting axial motion, which in this example would run lateral to the groove.

Figure 33:
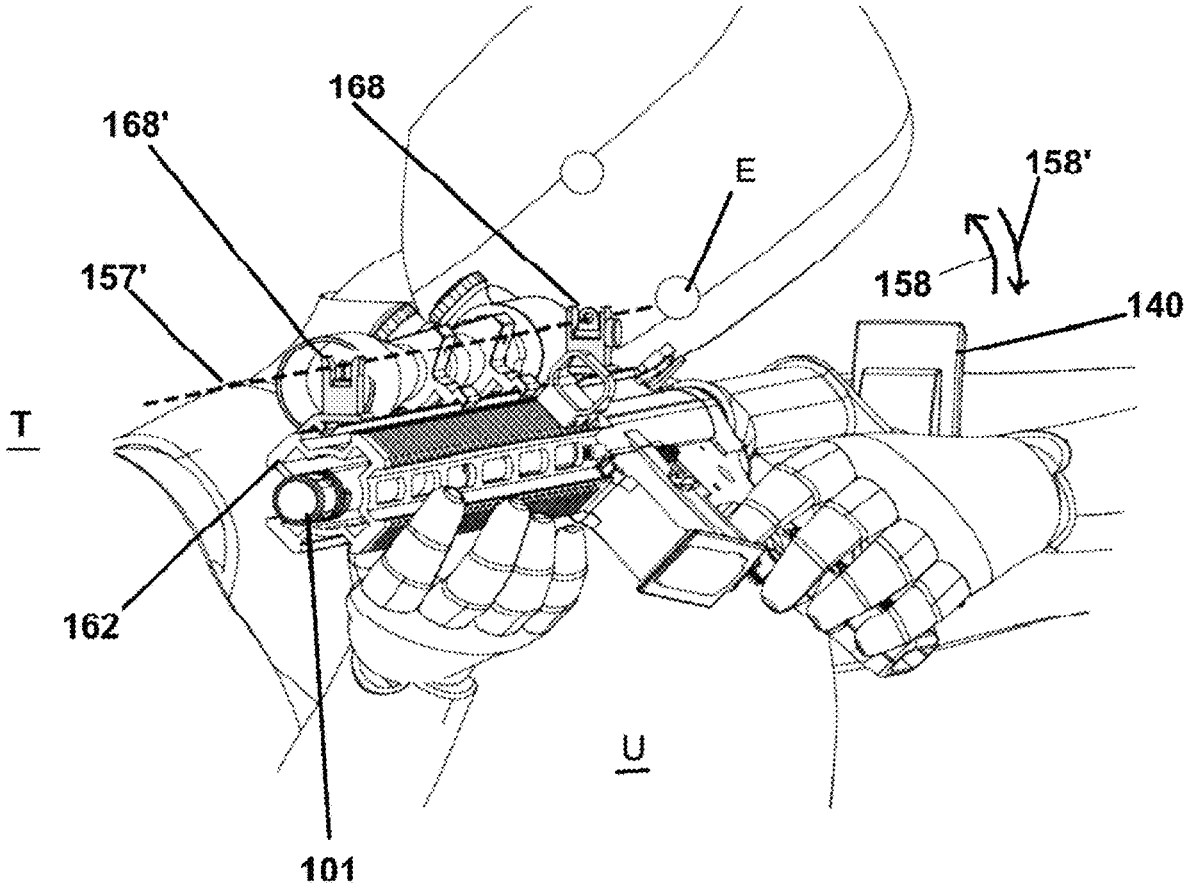
FIG. 33 is a perspective view of a user utilizing the invention of FIG. 32, by pivotally adjusting the firearm to facilitate line of sight aiming via an iron sight, also known as an open sight, situated at a forty-five-degree angle from the top mount of FIG. 32.

FIG. 33 illustrates the option of an iron or open sight comprising rear 168 and front 168' sights, respectively, which are mounted to the top rail 162 of the firearm and positioned to lie at a forty-five-degree angle therefrom on the outer side of the firearm 101. Alternatively, the sight could be mounted directly to the firearm at the forty-five-degree angle via a mount, rail or the like.

In the present example, referencing FIGS. 27-29 and 33, if the user U presently is aligned with the scope as shown in FIG. 32 and decides to utilize the iron or open site option, with the shoulder rest 140 in place, the firearm is pivoted 158 to dislodge spring 193 biased bearing 194 from the zero degree 203 groove 195 until it engages adjacent groove 199 at forty-five degrees 203', which engagement provides resistance to stabilize the firearm in that position while communicating to the user that the firearm's position is axially oriented so that the eye E of the user in alignment with the rear 168 and front 168 iron or open sights along the line of sight 157' aligned with the target T.

Figure 34:
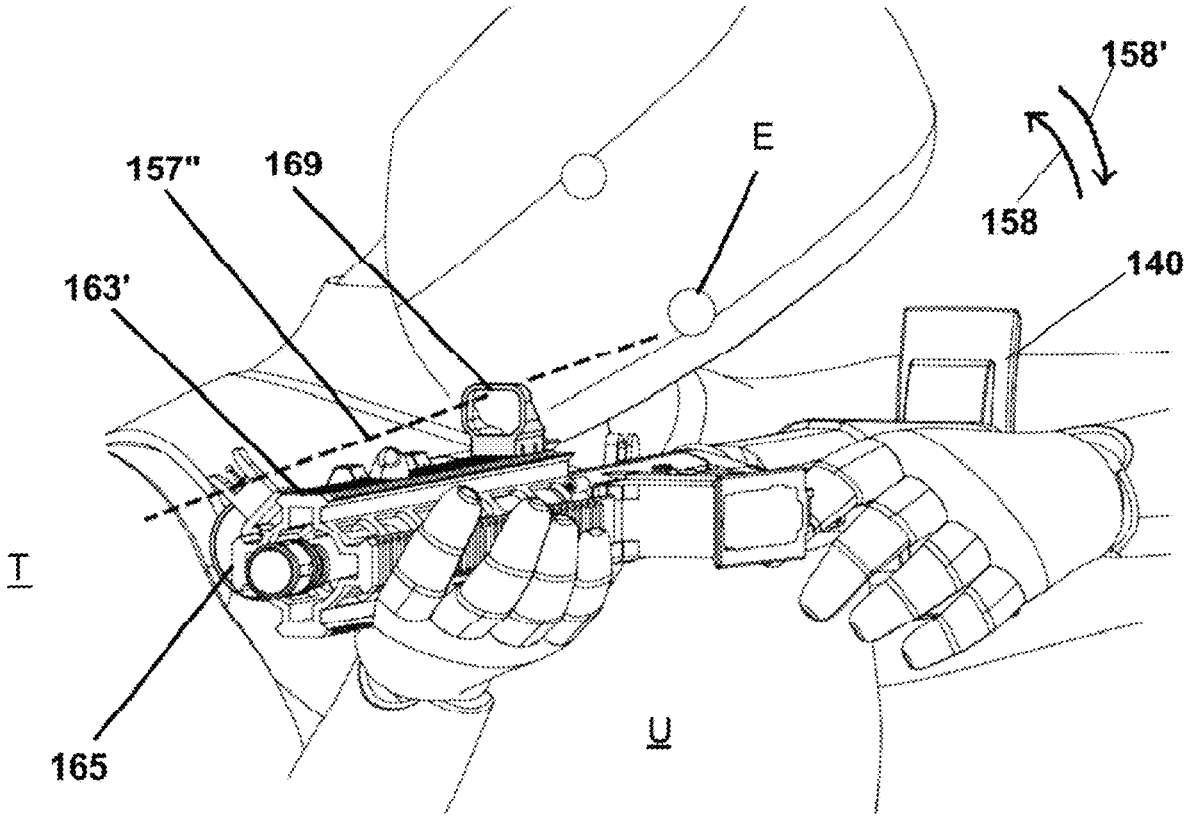
FIG. 34 is a perspective view illustrating a user utilizing invention of FIGS. 32-33, by pivotally adjusting the firearm to facilitate line of sight aiming via a reflex sight, situated at a ninety-degree angle relative to the top mount of FIG. 32.

FIG. 34 illustrates still another example or use, where the option of a reflex sight 169 is provided which is shown mounted to the outer side rail 163' of the firearm and as such is pivoted 158 to dislodge spring 193 biased bearing from the forty-five degree 203' groove 199 until it engages groove 199' at ninety degrees 203', which engagement provides resistance to further movement to stabilize the firearm in that position while communicating to the user that the firearm is axially positioned along at a forty-five degree angle relative to the position of the iron or open sites of FIG. 33, so that the user's U eye E is in line-of sight 157" alignment with reflex site 169 relative to the target T.

Figure 31:
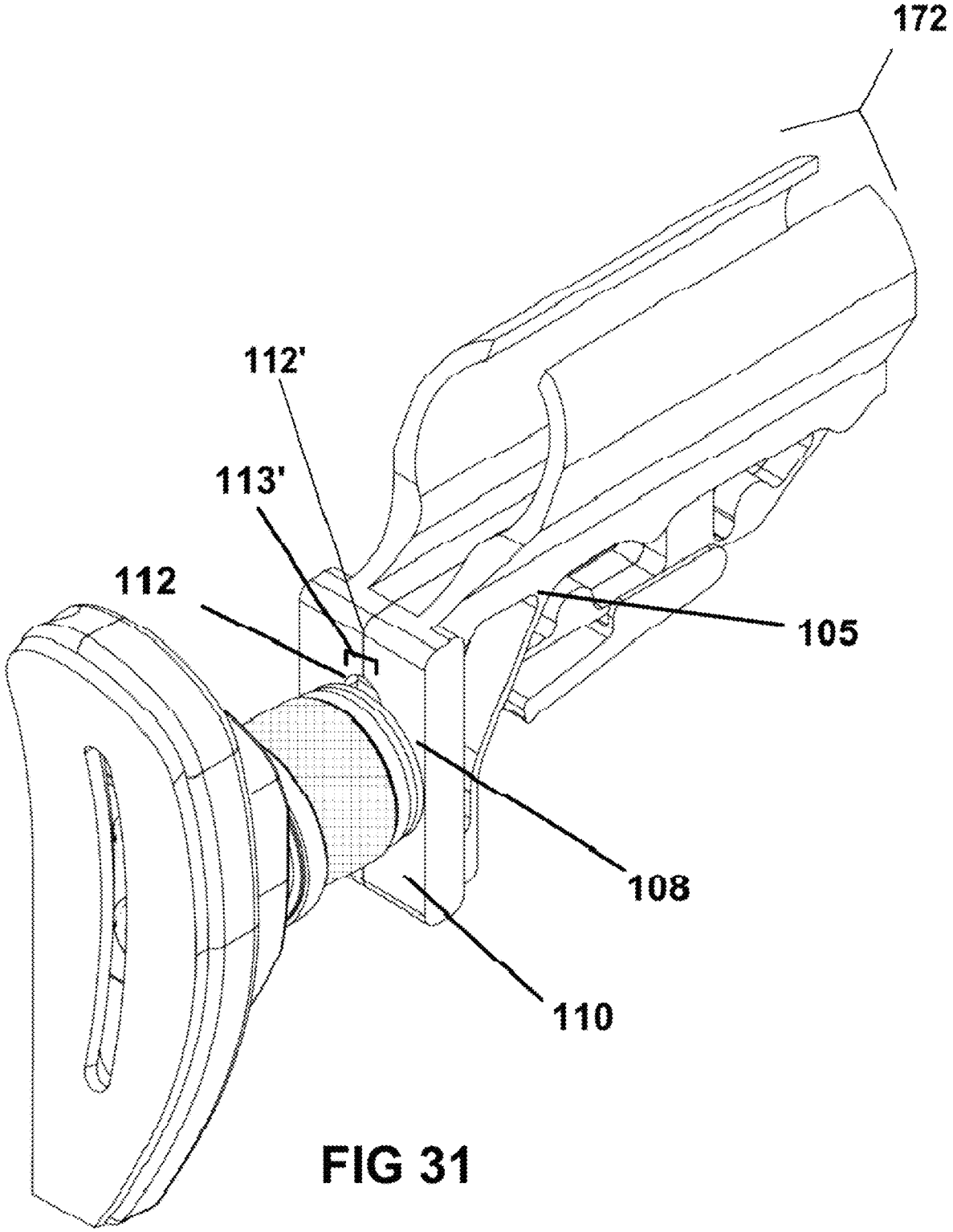
FIG. 31 is an upper, rear isometric view of the present invention.

FIG. 31 illustrates a cheek rest C which is adjustably mounted to the buttstock connector 130 via threaded fasteners or the like, and which is optional but can be effectively utilized by a user to further stabilize the firearm or gun during the target acquisition and aiming process.

It is further noted that, while grooves 195, 195', 195", 199, 199' are illustrated in the present example as radial lines emanating from a central point (i.e., center axis point 128), the grooves can be other configurations depending on the desired application, for example, concentric circles, indentations rather than lines, etc., which, in combination with specific placement relative to the bearing 194, would provide haptic feedback as to a desired orientation of the firearm or gun vs the shoulder rest.

Accordingly, the present invention allows a user the option of choosing from a variety of aiming options in real time by mounting an aiming option about the firearm as disclosed above, then utilizing the ball and socket connection earlier discussed to pivot and axially orient the firearm along its longitudinal axis to reposition the firearm to provide line-of-sight access to the desired aiming option by the user while in use, and utilize the biased ball bearing and groove arrangement as discussed above to provide haptic feedback regarding optimal orientations for sights mounted to the firearm, and when the firearm and shoulder rest are positioned at a predetermined orientation relative one another.

Based on the above, a summary of a method of use of the present invention could comprise, for example, the steps of:

a. providing a gun having rear stock having a butt plate, a pivot ball associated with said rear stock, said pivot ball having an outer diameter, said pivot ball further having a base formed to engage said butt plate;
   a shoulder rest formed to engage said rear stock via a socket having an inner wall engaging said pivot ball, so as to provide a swivel connection;
   a first sight mounted to said firearm along said longitudinal axis of said firearm;
   a second sight mounted to said firearm along said longitudinal axis of said firearm so that said second sight is pivotally spaced from said first sight;
b. providing a detent comprising a biased bearing in one of said ball or socket, and a first groove first and second detent components formed to releasably engage said ball and said socket so as to selectively limit swivel action between same, comprising the sub-step of positioning said first detent component along said outer diameter of said pivot ball and said second detent component along said inner wall of said socket so that their intersection and engagement are at a predetermined orientation of said gun and shoulder rest;
c. using said gun, comprising the sub-steps of:
   i. applying the shoulder rest of the gun to a shoulder of a user;
   ii. using said ball and socket to move relative one another in the form of swivel movement to position said gun for aiming at a target;
   iii. allowing said swivel movement to cause said first and second detent components to engage, providing resistance to further swivel movement between said ball and socket;
d. using said resistance to further swivel movement to provide feedback to the user to confirm said gun is at a predetermined orientation relative to said shoulder rest and one of said first or second sights to provide line-of-sight alignment with the user and said target.

It is noted that the exemplary detent feature of the present invention employing the spring-biased bearing emanating from the ball to engage the socket having grooves to receive the bearing is for illustrative purposes, and is not intended to be limiting, as other known detent mechanisms can likewise be employed depending on the application.

For example, instead of a spring biased ball bearing emanating from the ball (which could be referenced as first component of the detent mechanism), a spring-biased pin with rounded end emanating therefrom could be employed, and instead of a groove formed in the socket (which could be referenced as a second component of the detent mechanism), an indentation could be employed. Likewise, the spring-biased ball bearing could be alternatively made to emanate from a shaft formed in the socket, with the groove formed in the surface of the ball, instead of the illustrated example, which is visa-versa. Finally, instead of laterally emanating grooves emanating from a center axis, other groove or indentation configuration could likewise be employed, depending on the application.

Swivel with Return-to-Center Feature

Figure 41:
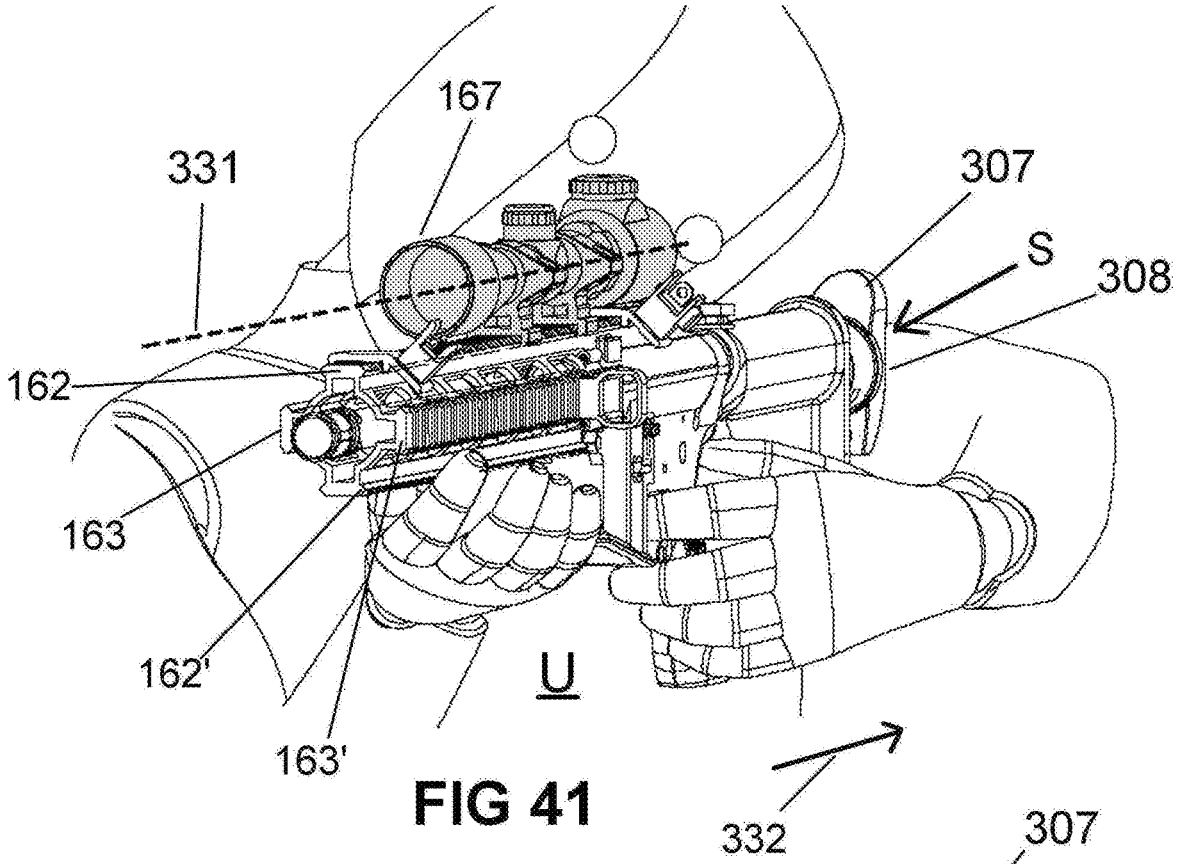
FIG. 41 is a perspective view of an exemplary user utilizing the third embodiment of the present invention of FIG. 35, at a zero-degree pivotal orientation via the buttstock swivel assembly to facilitate line of sight aiming through the top scope, or other sighting device situated along the top mount of the firearm.
Figure 42:
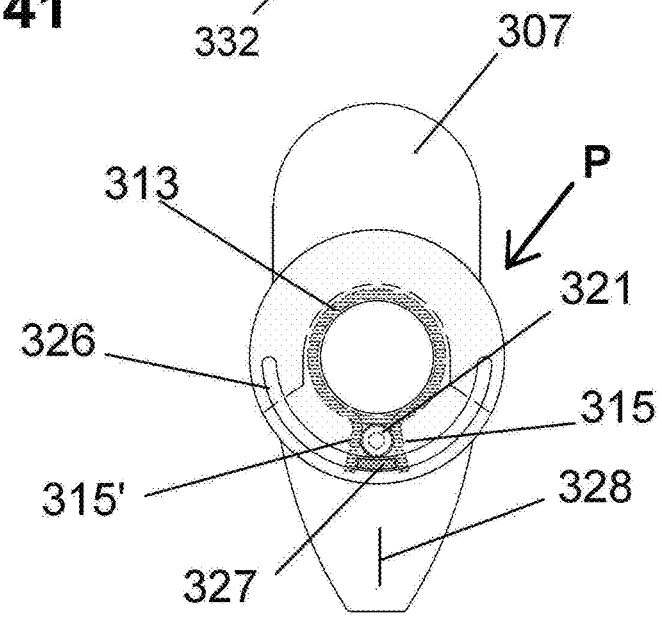
FIG. 42 is side, end, partially cut-away view of the invention of FIG. 35, illustrating the position of the centering tab in the zero-degree position of the system shown in FIG. 41.
Figure 45:
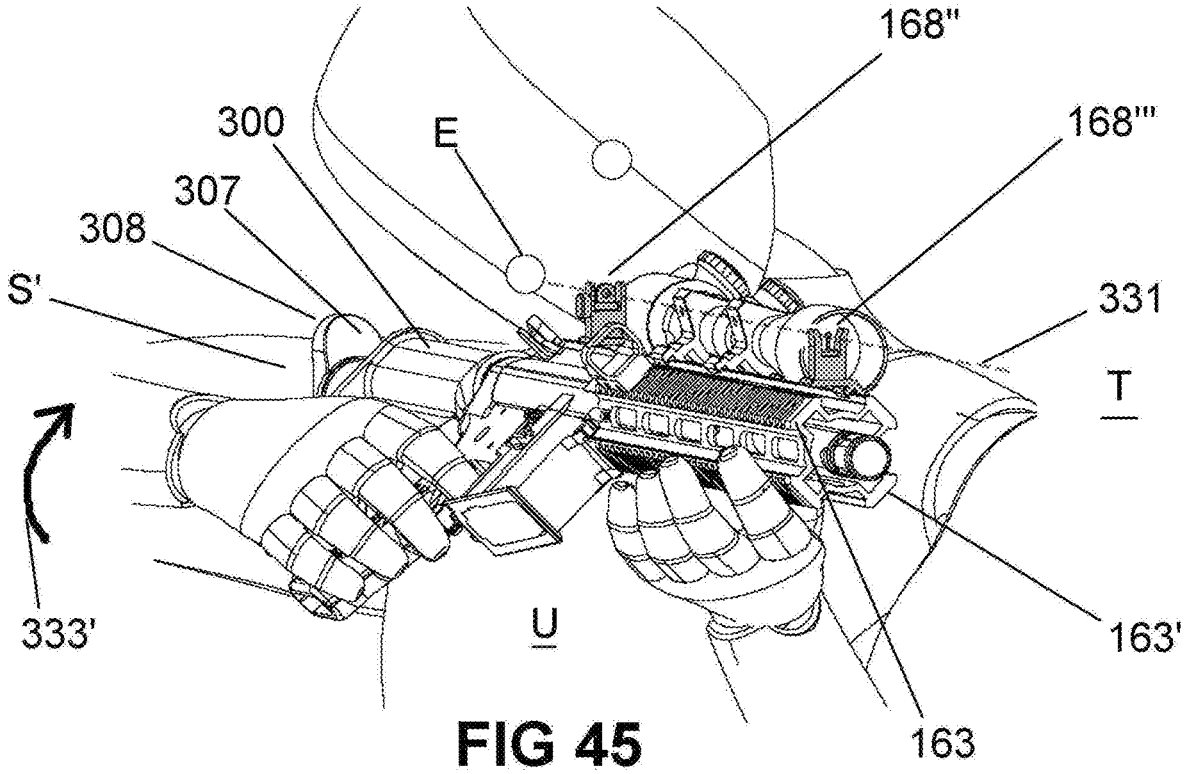
FIG. 45 is a perspective view of a user utilizing the invention of FIG. 35, at a forty-five degree (left) pivotal orientation via the buttstock swivel assembly to facilitate line-of-sight aiming via a second iron sight, also known as an open sight, situated at a (left) forty-five-degree angle from the top mount of FIG. 42.
Figure 46:
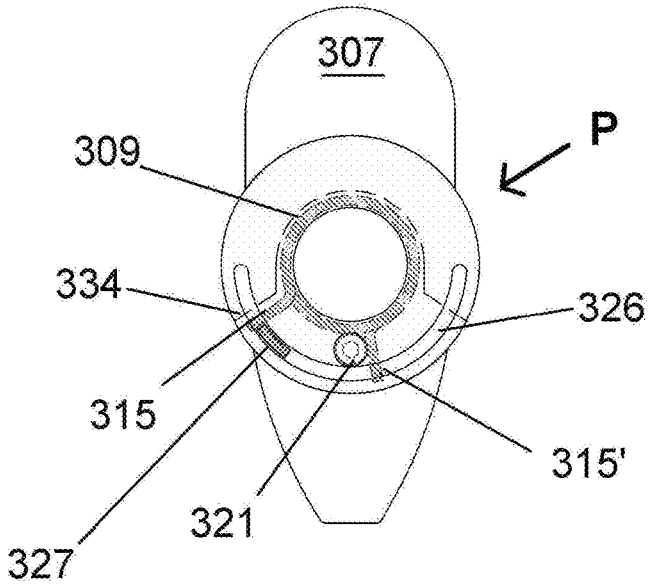
FIG. 46 is a side, end, partially cut-away view of the invention of FIG. 35, illustrating the position of the centering tab in the forty-five-degree (left) position of the system shown in FIG. 45.
Figure 47:
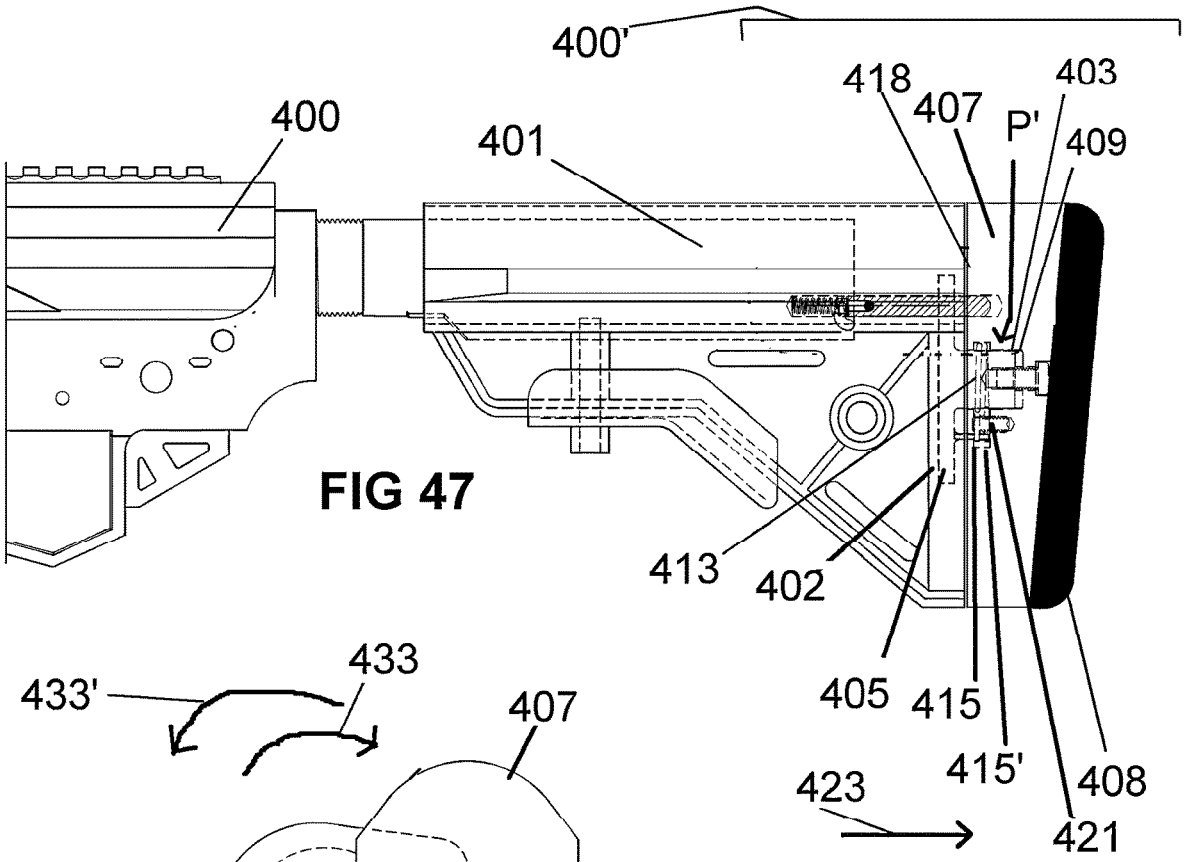
FIG. 47 is a side view of the of an alternative embodiment of the invention of FIGS. 35-46, illustrating a more traditional-style buttstock or rear stock, with the pivot mechanism of FIGS. 35-46 incorporated with a more traditional-style shoulder rest (referenced as P'), this embodiment further including a pivotal locking capability via locking pin in a locking mechanism, allowing the user to enable and disable the pivot feature at will.

Continuing with FIGS. 35-46 (minimalist embodiment 300') and FIGS. 47-42 (conventional embodiment with locking mechanism) present a third, alternative embodiment of present invention comprising a common a pivot mechanism P, P' respectively, a firearm providing a pivotal shoulder rest engaging the buttstock or rear stock of the firearm, with the capability of enabling the user to pivot the firearm in either direction a predetermined amount of degrees (shown in the present illustration about forty-five degrees) from a center position, relative to the shoulder rest against the user's shoulder in a neutral or zero degree position, but with the added feature of providing spring bias to the pivot mechanism P, P', to urge the pivoted firearm to the center position once the user releases the shoulder rest from their shoulder, or no longer provides bias to pivot.

Minimalist-Style Buttstock Version

The invention of FIGS. 35-46 invention comprises a unique and useful pivot mechanism in a "minimalist" embodiment 300' but with a pivot mechanism P which can be utilized to provide a pivotal connection with a variety of configurations of rear stocks (also referenced as buttstock) and shoulder rests, a providing biased, return-to-zero utility, as well as locking and non-locking pivot elements, as will be discussed in detail herein, the first example of the present invention in the aforementioned figures illustrating the pivot mechanism P implemented in conjunction with a 'minimalist" rear stock or buttstock 301 style, providing a spring-biased pivot with a "minimalist" shoulder-cup style shoulder rest 308, and referenced as the minimalist embodiment 300'.

Continuing with FIGS. 35-46, the pivot mechanism P comprises a rotation post 303 having an outer diameter (OD) 304, length 304' and threaded aperture 304" at its center, the rotation post 303 situated on a flange 305 mounted to a spacer or base 306 which is in turn mounted to or otherwise emanating from buttplate 302 of rear stock or buttstock 301. A buttstock pivot piece 307 is formed to provide or has mounted to a shoulder rest 308 configured to engage a user's shoulder is provided at a second end 318' of said buttstock pivot piece, with a post receiver 309 formed in the first end 318 of said buttstock pivot piece. The post receiver 309 comprises an inner diameter 310 and a depth 310' formed to envelope and slidingly receive said outer diameter 304 of said rotation post 303. A screw aperture 311" forming an opening at second end 318' end of said shoulder rest is formed to provide passage from said shoulder rest 308 to said post receiver 309, said screw aperture 311" positioned to provide screw or threaded fastener 320 access to threaded aperture 304" formed in rotation post 303, via inset 319 formed in shoulder rest 308, with a washer 325 about said threaded fastener 320 between said rotation post 303 and said rotation post receiver, 309, so as to pivotally secure said buttstock pivot piece 307 to said rotation post 303 via said threaded fastener 320, as will be more fully disclosed herein.

Figure 38:
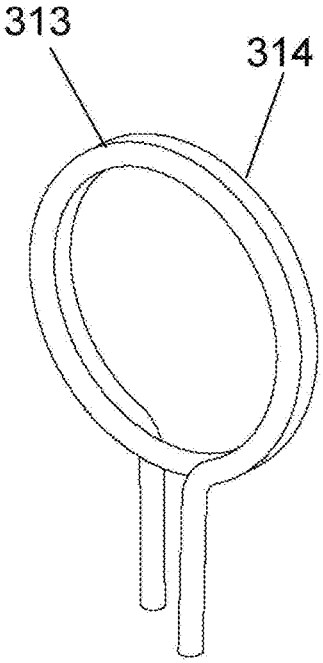
FIG. 38 is a side, perspective view of the torsional centering spring of FIG. 37.
Figure 39:
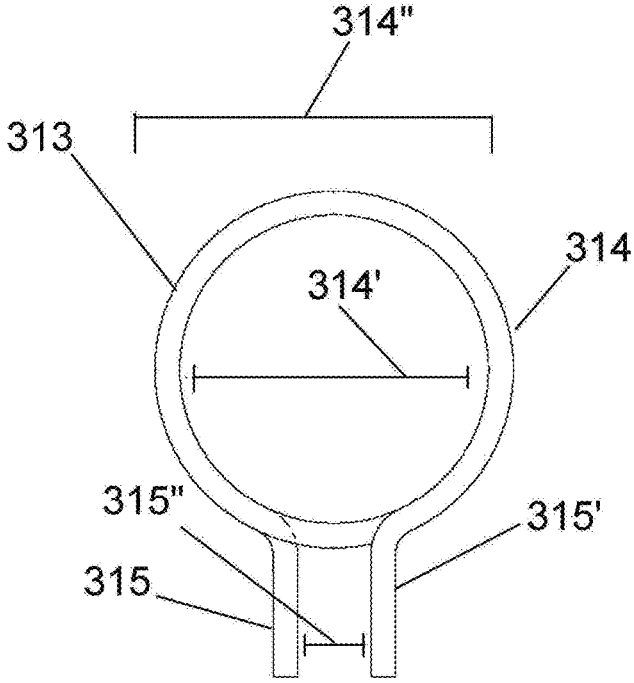
FIG. 39 is a side, frontal view of the torsional centering spring of FIG. 38.
Figure 40:
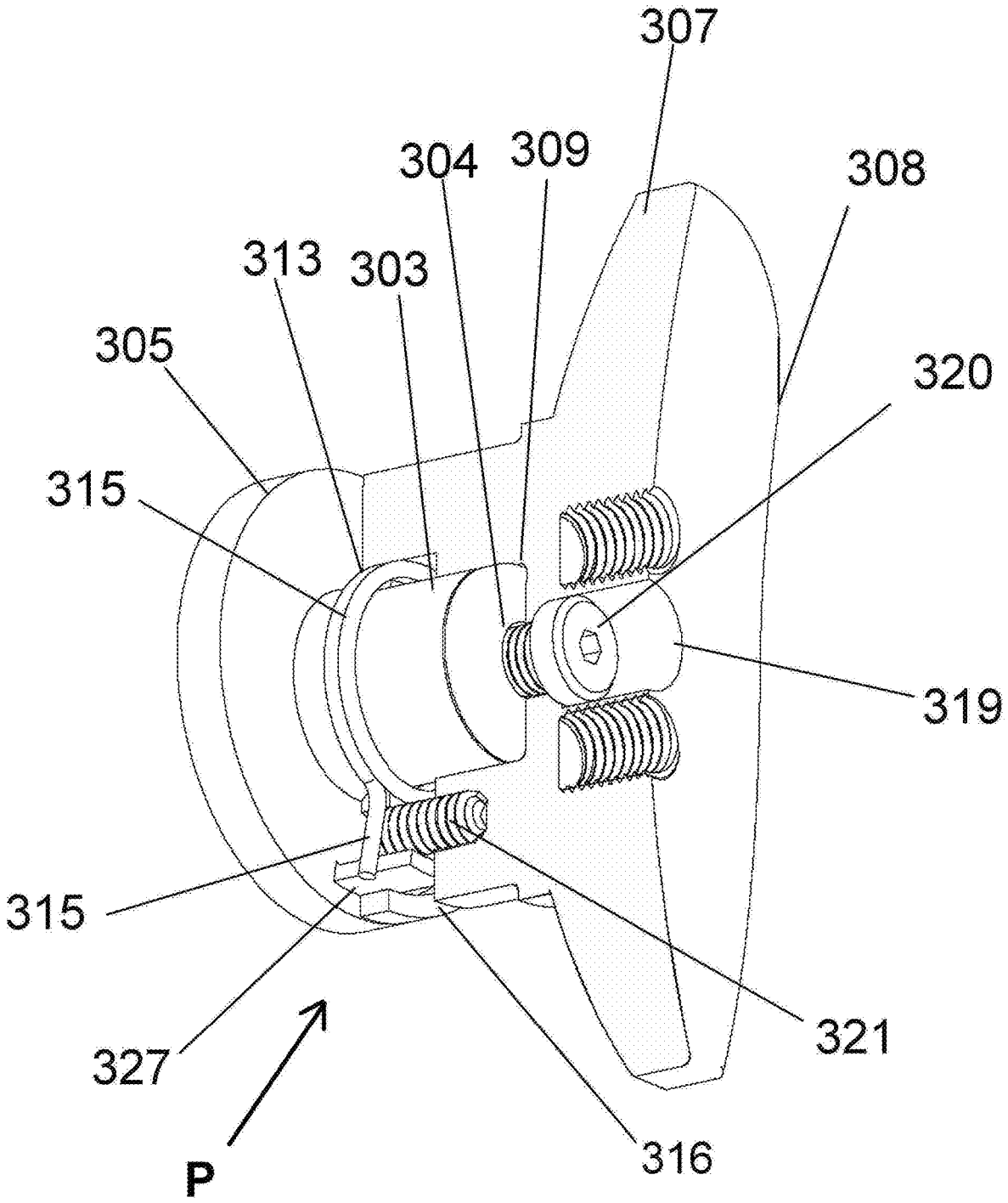
FIG. 40 is a partial, side, perspective, partially cut-away view of the assembled buttstock swivel assembly engaged to the rotation post with centering tab of FIG. 36.

Continuing with FIGS. 38-39, a centering spring 313 is provided in the pivot mechanism P of the present invention, in the form of a torsion spring comprising a length of spring wire having first and second ends and a length manipulated to form a loop 314 having an inner diameter 314' and outer diameter 314", said first end forming a first leg 315, said second end forming a second leg 315' in generally parallel orientation relative towards one another, with a space 315" formed therebetween, which typically is heat treated. In the present, preferred, exemplary embodiment of the invention, the torsion spring comprises 0.059" diameter ASTM A228 wire, with the loop 314 having an OD of 0.875" and ID of 0.757", 1.75 total coils, left hand wound, with 0.18" space 315" between legs 315, 315', respectively.

Figure 37:
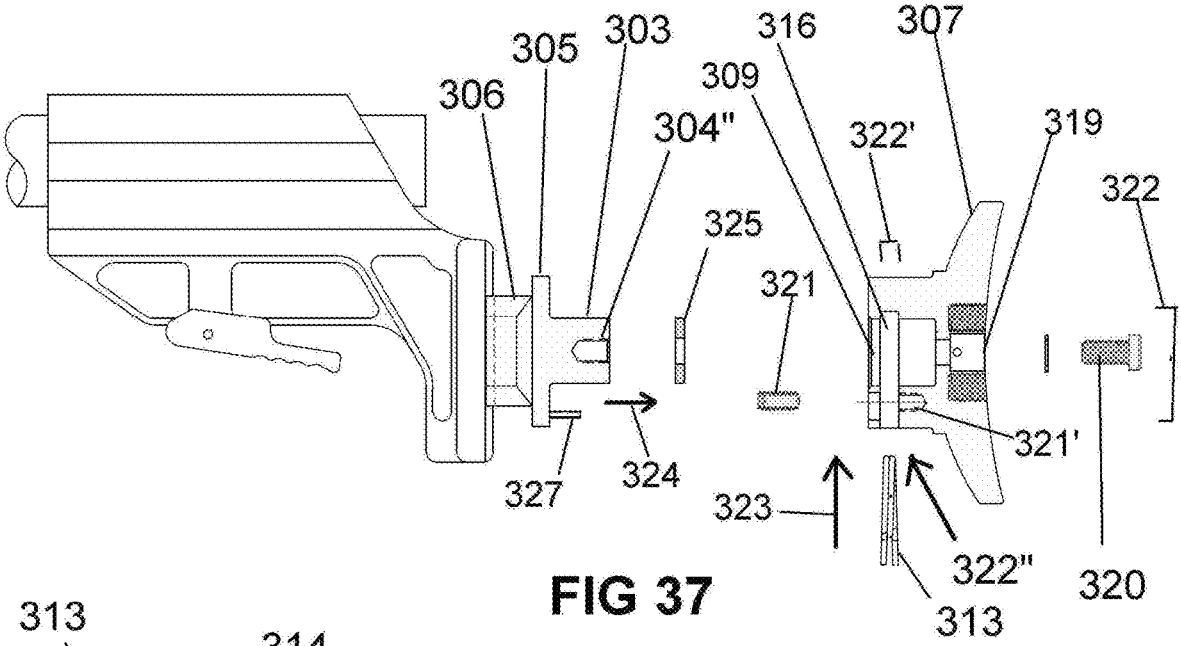
FIG. 37 is a side, partially exploded view of the invention of FIG. 35.

Continuing with FIG. 37, buttstock pivot piece 307 has a spring slot 316 formed therein having a width 322', depth 322", and length 322 sized to accommodate the insertion 323 of centering spring 313 therein, with loop 314 end first, so that the ID 314' of loop 314 is aligned with the ID 310 of rotation post receiver 309 to receive via insertion 324 the outer diameter 304 of rotation post 303 therein so that the length 304' of rotation post 303 is situated within rotation post receiver 309 and pivotally secured via threaded fastener 320 with washer 325 (preferably formed with a self-lubricating material such as, for example PTFE) situated between said rotation post 303 and rotation post receiver 309 via threaded fastener 320 engaging threaded aperture 304".

The first end 318 of buttstock pivot piece 307 has formed therein a radial slot 326 having a length 330 evenly spaced from the inner diameter 310 of rotation post receiver 309, while providing passage via the first end 318 to spring slot 316. Said radial slot 326 has first 330' and second 330" ends with a medial area 330" therebetween, said radial slot 326 formed to have positioned 329 therein and receive centering tab 327 emanating from flange 305 of rotation post 303, so as to allow said tab to slide within the length of said radial slot 326, while limiting rotational or pivotal movement of associated rotation post 303 as it relates to said buttstock pivot piece 307 upon reaching opposing ends 330', 330" of said radial slot 326.

Upon insertion 323 of said centering spring 313 via its loop 315 end first into spring slot 316, said first 315 and second 315' legs of said centering spring are situated medially along said radial slot 326 and centered along same via spring centering anchor comprising a threaded fastener 321 engaging threaded aperture 321' between said first 315 and second 315' legs in said spring slot 316, which threaded aperture 321' is situated between said radial slot 326 and said inner diameter 310 of said rotation post receiver 309.

Said centering tab 327 is positioned 329 for insertion into said medial area 330" of said radial slot 326, so that said width 327' of said centering tab 327 is situated between said first 315 and second 315' legs of said centering spring 313, with said flange 305 resting against said first end 318 of said buttstock pivot piece 307.

After insertion 324 of the rotation post 303 into rotation post receiver 309 with centering tab 327 guided into said radial groove so that said centering tab 327 situated between said legs 315, 315' of centering spring 313 situated in said spring slot 316, the two components (said buttstock pivot piece 307 and said rotation post 303) are then pivotally centered to the medial area of radial slot 326 via threaded fastener 320, with washer 325 therebetween, to threaded aperture 321'. Pivotally secured as described, the centering spring is provided to pivotally bias the shoulder rest 308 to a neutral or centered position, as it relates to the firearm to which it is mounted (shown in FIGS. 41 and 42).

The centering spring 313 provides spring bias via said first 315 and second 315' legs upon pivoting the firearm, with said shoulder rest 308 engaging the shoulder S of a user U with no spring bias when the firearm 300 is in the zero degree or neutral position 328, as shown in FIGS. 42 and 41.

The pivot mechanism P as mounted to a firearm in the above example is particularly suited to aid in the competition shooting, hunting, or military use of firearms, providing a stable anchor point for the rifle (via shoulder rest 308 engaging the pocket of the shoulder S of the user U to maintain line of sight 331 anchor point consistent through motion shooting and pivoting of the gun long its longitudinal axis in use in a variety of applications, including but not limited to improving line-of-sight aiming and target acquisition on a firearm having more than one sighting device mounted thereto.

As with the previously discussed embodiments, one or more rail mounts (shown as top 162, bottom 162', and first and second opposing side 163, 163' mounts, respectively) can be mounted along the length of the firearm for mounting various accessories such as lasers, flashlights, supports such as bipods or monopods, carrying handles, sling mounts, various sighting options, etc. More than one rail can be mounted at, for example, 90 degrees relative to one another (as shown in the figures) on the firearm as well as other orientations including 45 degrees via mounts to said rail(s) or extensions therefrom, for example.

FIG. 41 shows the firearm 300 situated in a horizontal shooting position with the scope situated along the top rail 162 mounted to the firearm 300. In use, continuing with FIGS. 41 and 42, the user U positions 332 the shoulder rest 308 in the pocket of the shoulder, and allows the centering spring 313 to assert spring bias via said first 315 and second 315' legs engaging the centering tab 329 to urge axial orientation in the zero degree or neutral position 328 (via the earlier described pivotal connection of the rotation post 303 and buttstock pivot piece 307 via the rotation post receiver 309 swivel in FIG. 40) with the scope 167 at zero degrees and providing user with a line of sight 331 through the target via scope 167 and aim the firearm accordingly. It is noted that zero degrees is used only as an example of optimal orientation for line-of-sight and this can vary depending on the user's preferences and position.

Figure 43:
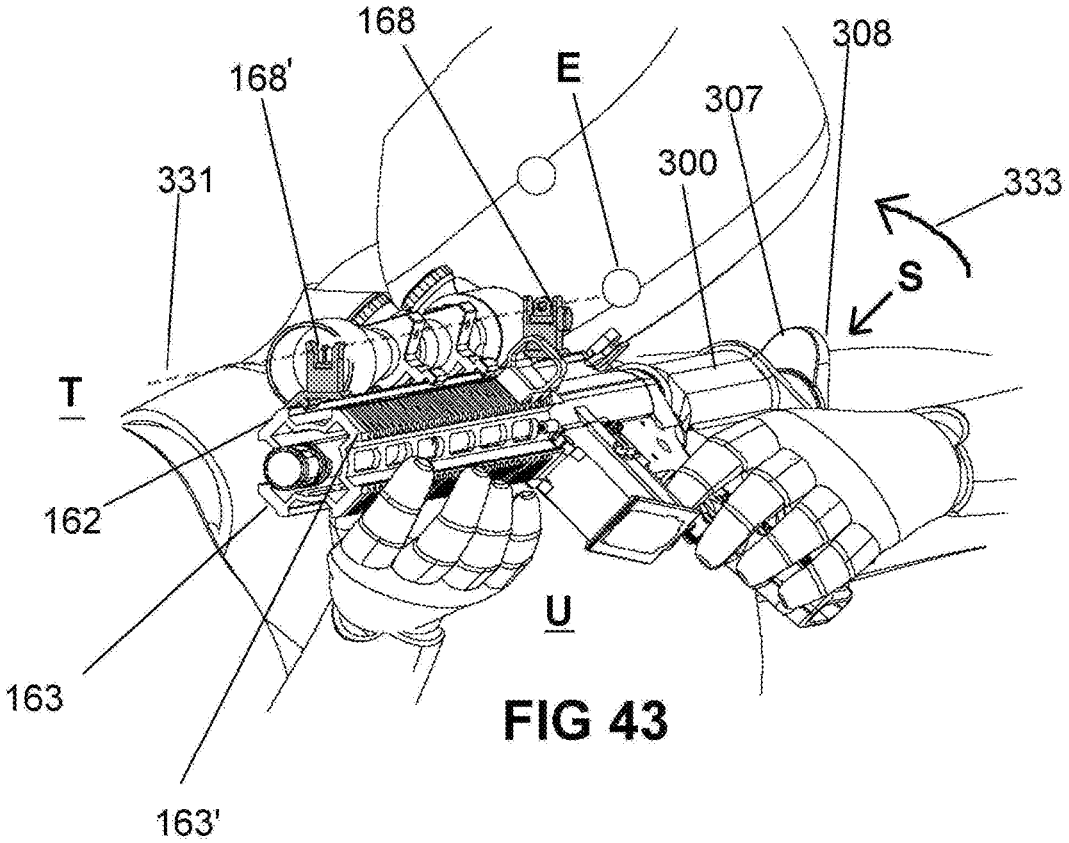
FIG. 43 is a perspective view of a user utilizing the invention of FIG. 35, at a forty-five degree right pivotal orientation via the buttstock swivel assembly to facilitate line-of-sight aiming via a first iron sight, also known as an open sight, situated at an exemplary (right) forty-five-degree angle from the top mount of FIG. 42.
Figure 44:
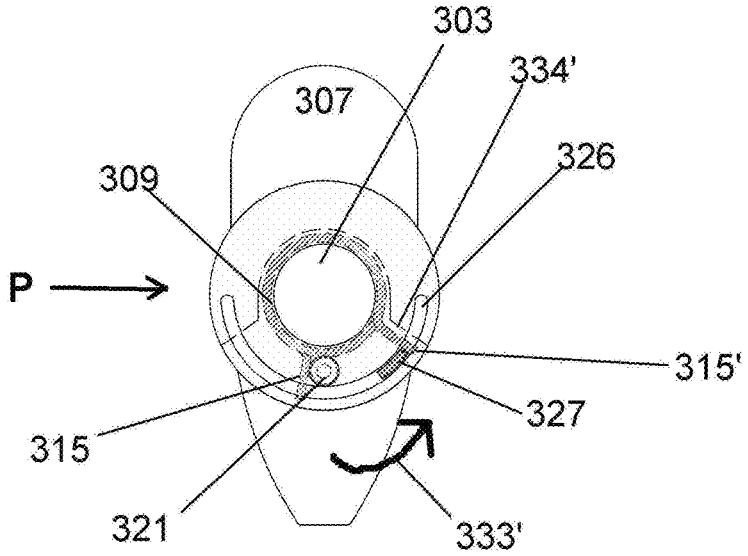
FIG. 44 is a side, end, partially cut-away view of the invention of FIG. 35, illustrating the position of the centering tab in the forty-five degree (right) pivotal orientation of the system shown in FIG. 43.

FIGS. 43 and 44 illustrates the user U having left pivoted 333 the firearm 300 from the zero degree or neutral orientation (328 shown in FIG. 42) relative to the buttstock pivot piece 307 and shoulder rest 308, to provide line of sight 331 aiming via a first iron or open sight comprising rear 168 and front 168' sights (on the shooter's right side from the perspective of the shooter), respectively, which are mounted to the top rail 162 of the firearm and positioned to lie at a forty-five-degree angle therefrom on the outer side of the firearm 300. Alternatively, the sight could be mounted directly to the firearm at the forty-five-degree angle via a mount, rail or the like.

In the present example, referencing FIGS. 40-44, if the user U presently is aligned with the scope 167 of the firearm positioned in the zero or neutral position 328 (FIGS. 41 and 42) and desires to utilize the iron or open site 168, 168' (FIG. 43), then with the shoulder rest 308 engaging the shoulder of the user U, the firearm 300 is pivoted to the left 333 relative to the buttstock pivot piece 307 fixed against the user U shoulder S, which causes rotation post 303 to rotate within rotation post receiver 309, the user U applying pivot force to cause centering tab 327 in radial slot 326 to overcome the spring bias of centering spring 313 to urge said second leg 315' away from said first leg 315 (which is engages and is stopped by centering anchor threaded fastener 321 at the zero degree position) and along said radial slot 326 until it reaches about forty-five degrees to the neutral position shown in FIGS. 41 and 42, on the right side of the firearm (relative to the user). Note that centering anchor threaded fastener 321 is situated between radial slot 326 and rotation post receiver 309, so as not to block radial slot 326 or impede the movement of centering tab 327 along the length of said radial slot 326. Alternatively, user continues to pivot until centering tab 327 in radial slot 326 encounters an added stop 334' formed to block radial slot 326 at a position along said radial slot where the firearm is tilted at forty-five degrees relative to buttstock pivot piece 307 and neutral position (328 in FIGS. 41 and 42), the stop 334' formed to prevent further right 333 pivot or rotation bot stopping center tab 327 further movement along said radial slot 327. The stop 334' further can be used to communicate to the user that the firearm's position is axially oriented when the stop is reached, so that the eye E of the user is a position for relative alignment with the rear 168 and front 168 iron or open sights along the line of sight 331, and thereby aligned with the target T.

Continuing with FIGS. 45-46, if the user U presently is aligned with the scope 167 with of the firearm positioned in the zero or neutral position 328 (FIGS. 41 and 42) and desires to utilize the second or left side (from the perspective of the user U) iron or open site 168", 168'" (FIG. 45), then with the shoulder rest 308 engaging the left shoulder S' of the user U and from the zero or neutral position, the firearm 300 is pivoted to the right 333' which causes rotation post 303 to rotate within rotation post receiver 309, the user U applying pivot force to cause centering tab 327 in radial slot 326 to overcome the spring bias of centering spring 313 to urge its first leg 315 away from said second leg 315' (which is engages and is stopped by centering anchor threaded fastener 321 at the zero degree position) said centering tab 327 traversing said radial slot 326 until said centering tab 327 reaches about forty-five degrees relative to buttstock pivot piece 307 and neutral position (328 in FIGS. 41 and 42). Alternatively, user U pivots until centering tab 327 in radial slot 326 encounters a stop 334 situated at forty-five degrees relative to the neutral position in discussed in FIG. 41, which prevents further pivot or rotation, the stop thereby communicating to the user that the firearm's position is axially oriented at 45 degrees so that the eye E of the user in alignment with the left-side, first 168" and 168'" iron or open sights along the line of sight 331, and thereby aligned with the target T.

It is noted that, while the present embodiment of FIGS. 35-47 teaches an example of the above spring-biased pivoting mechanism in use with a firearm comprising a minimalist-style buttstock and buttstock pivot piece with shoulder rest, the example is not intended to be limiting as to the style of buttstock and shoulder rest.

Conventional Buttstock and Shoulder Rest Embodiment with Locking Feature

An alternative embodiment to the above invention of FIGS. 35-46 (previously referenced above as the minimalist embodiment 300'), is illustrated in FIGS. 47-52, presenting a firearm 400 having a more conventional-appearing style buttstock 401 and shoulder rest 408 combination when compared to the previously discussed minimalist embodiment, the present invention referenced herein in the following discussion as the conventional embodiment 400'. While different in outward appearance, the present embodiment incorporates a pivot mechanism P' of similar design with the same components and operation as the pivot mechanism (P in FIGS. 35-46) of the minimalist embodiment, with minor differences.

Figure 35:
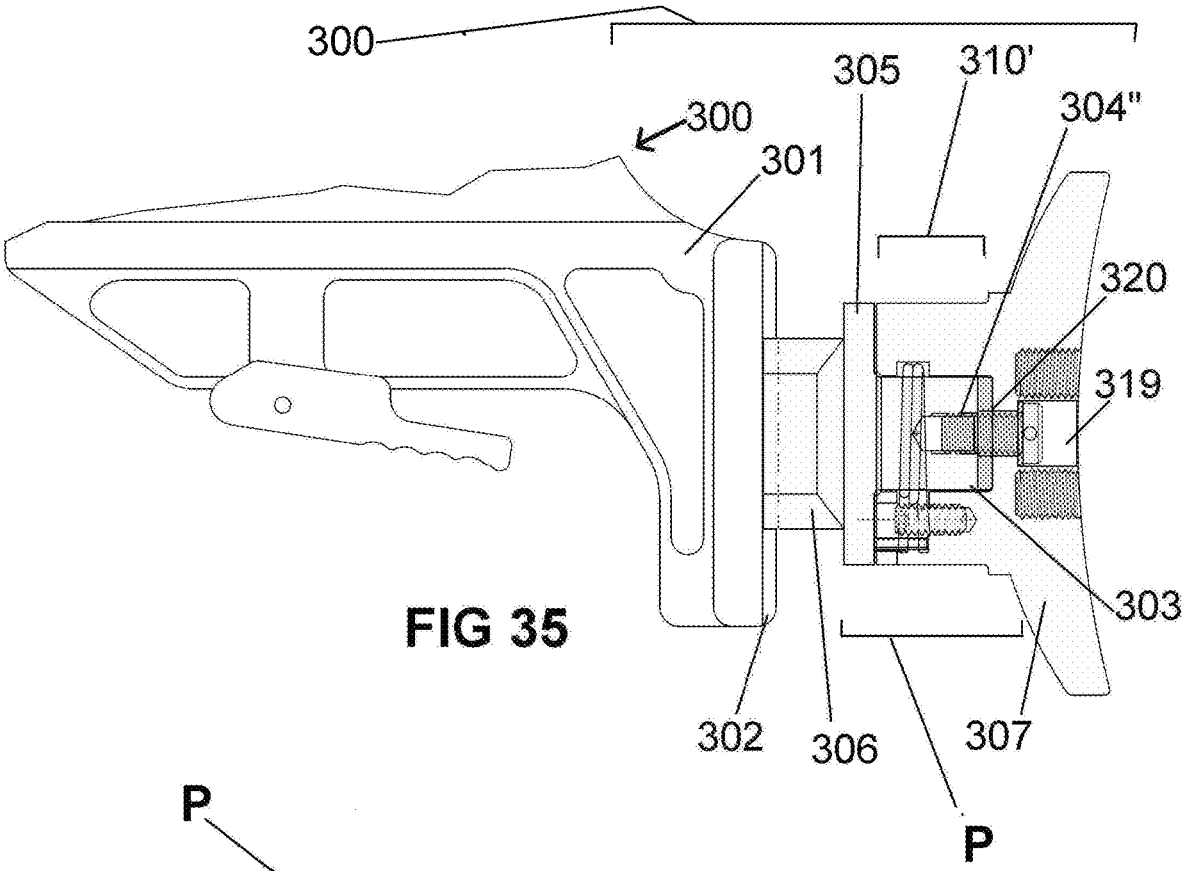
FIG. 35 is a side, perspective view of the partially cutaway view of a third alternative embodiment of the invention of FIGS. 1-17, illustrating a minimalist-style buttstock with buttstock pivot piece mounted thereto having spring-biased return-to-center capability.
Figure 36:
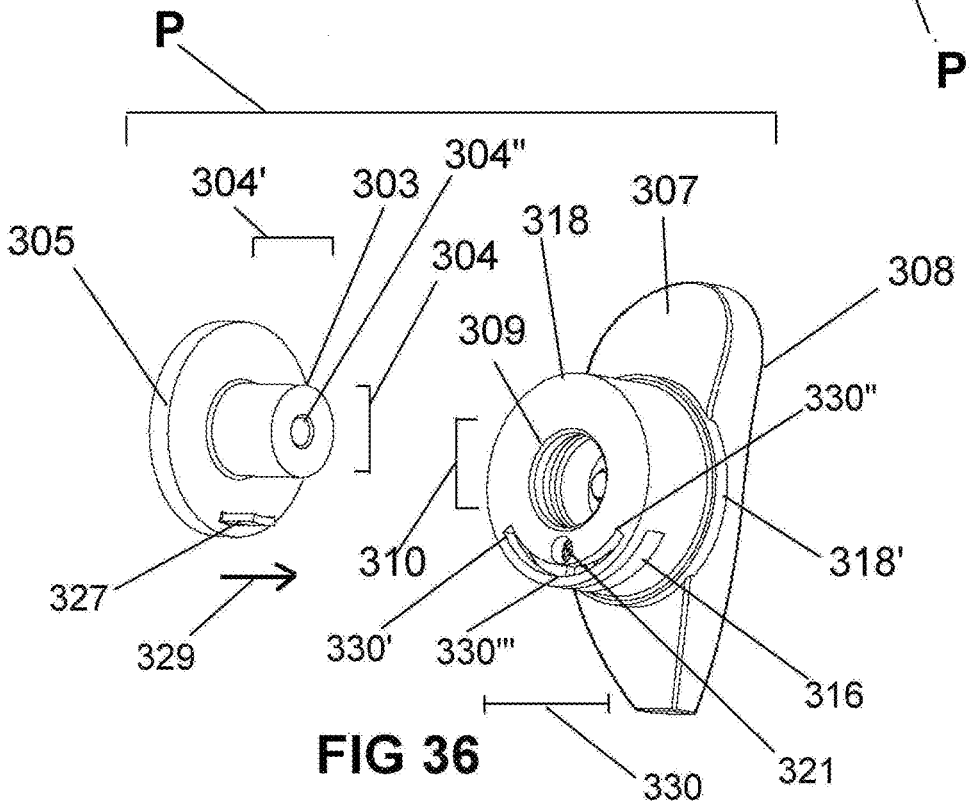
FIG. 36 is a partial, side, perspective, partially exploded view of the invention of FIG. 35, illustrating the rotation post with centering tab association with the buttstock swivel assembly with torsion-type centering spring.
Figure 48:
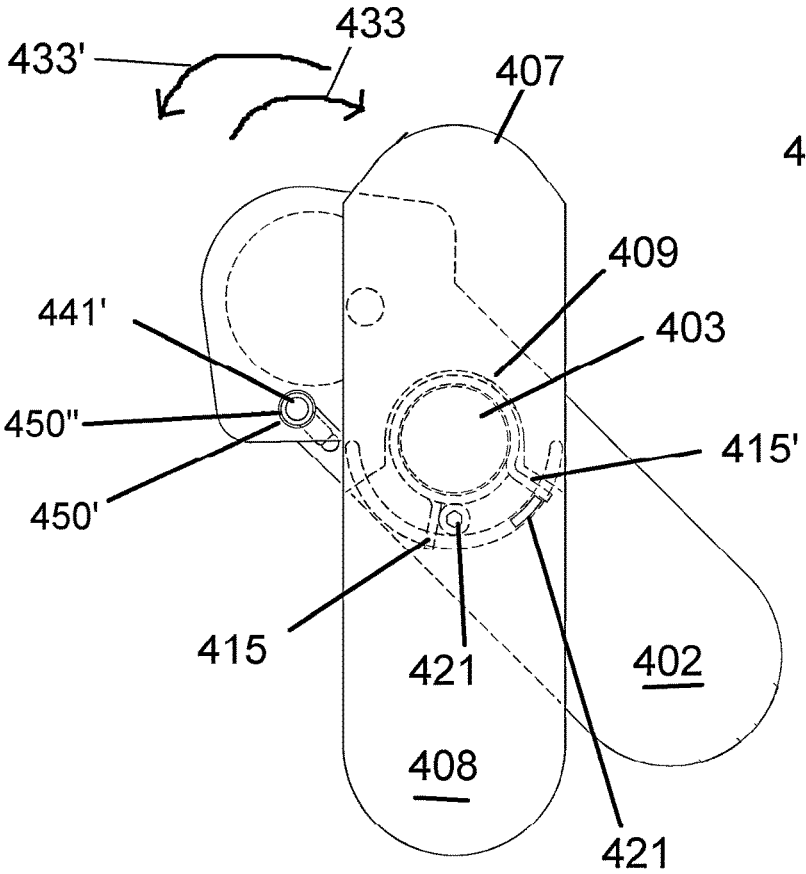
FIG. 48 is a rear end view of the invention of FIG. 47, viewing the end of the firearm at the shoulder rest, showing the firearm pivoted relative to the shoulder rest at a forty-five (45) degree angle, illustrating in phantom the spring-biased pivot mechanism P' and locking pin and pin receiving passage formed to selectively receive the locking pin via locking mechanism, to maintain the shoulder rest in a zero degree or neutral position relative to the firearm.
Figure 49:
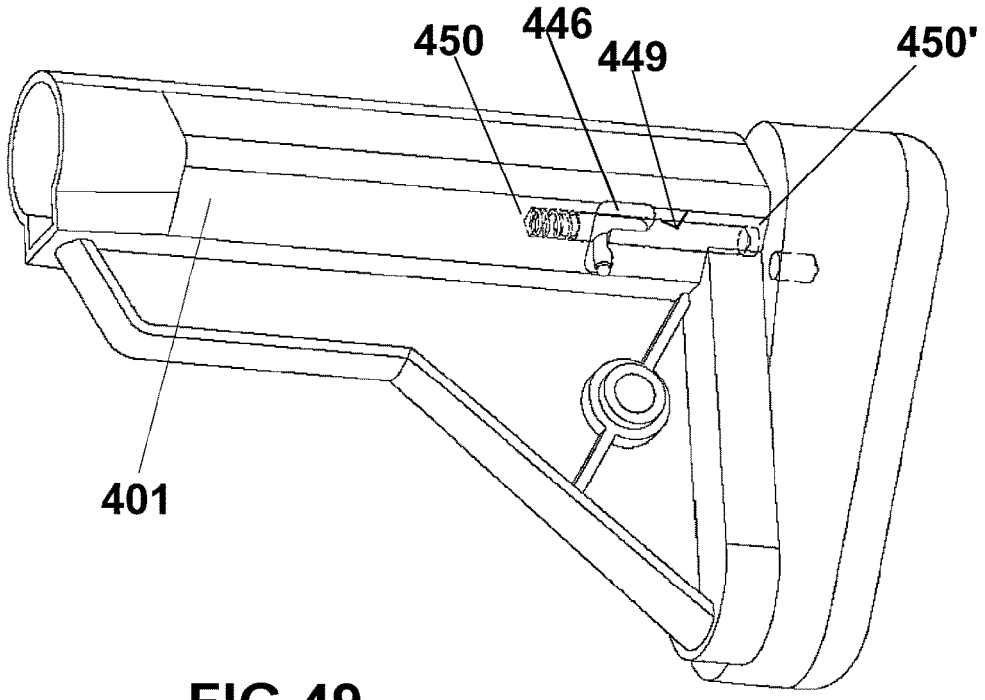
FIG. 49 is a side, perspective view of the invention of FIG. 47, illustrating the locking pin in its retracted state in the locking mechanism, releasing the shoulder rest and allowing pivoting of same.
Figure 50:
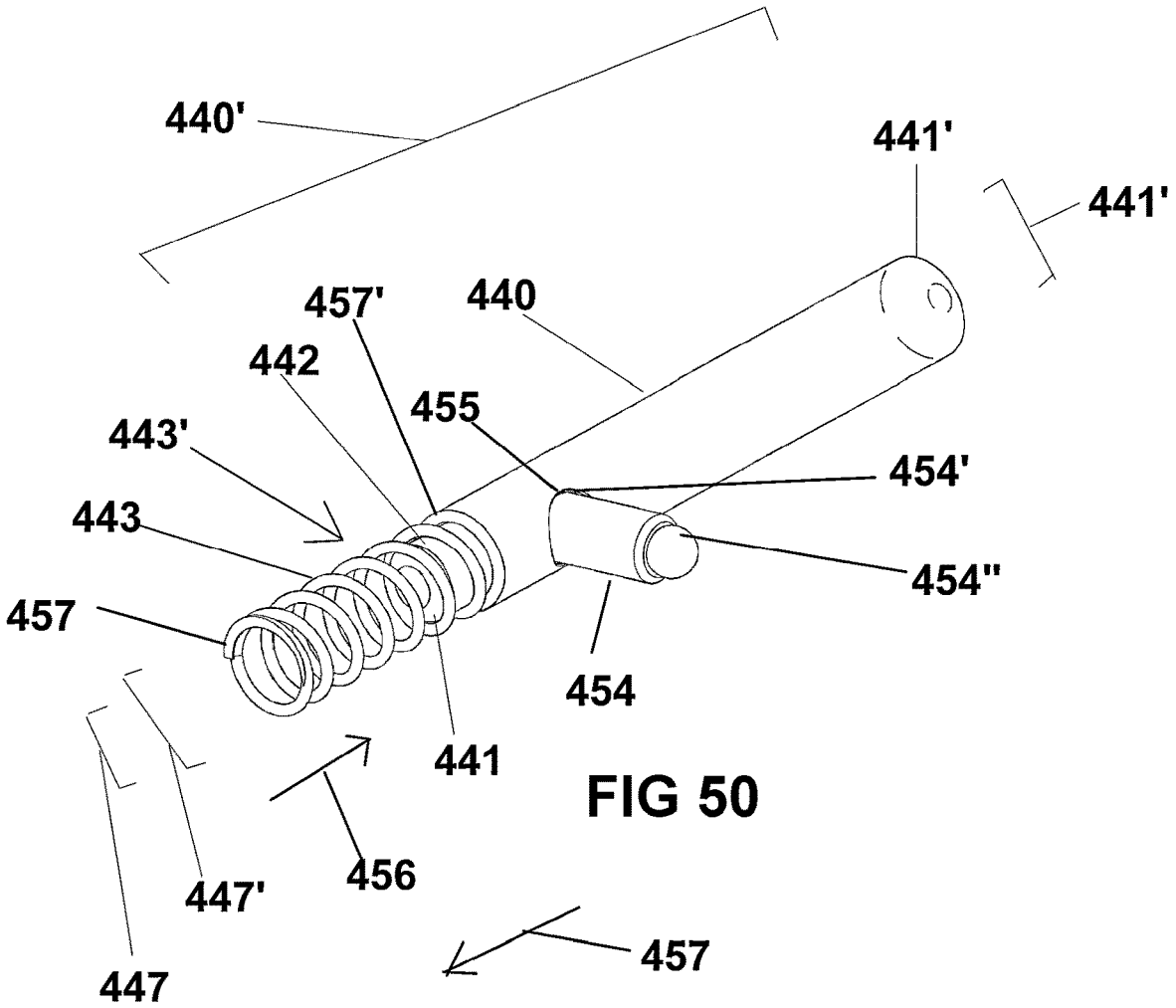
FIG. 50 is a perspective, side, close-up view of the locking pin of FIG. 49, with coil spring engaging a spring guide positioned at the forward part of locking pin, and lock pin handle for retaining the locking pin in the unlocked position.
Figure 51:
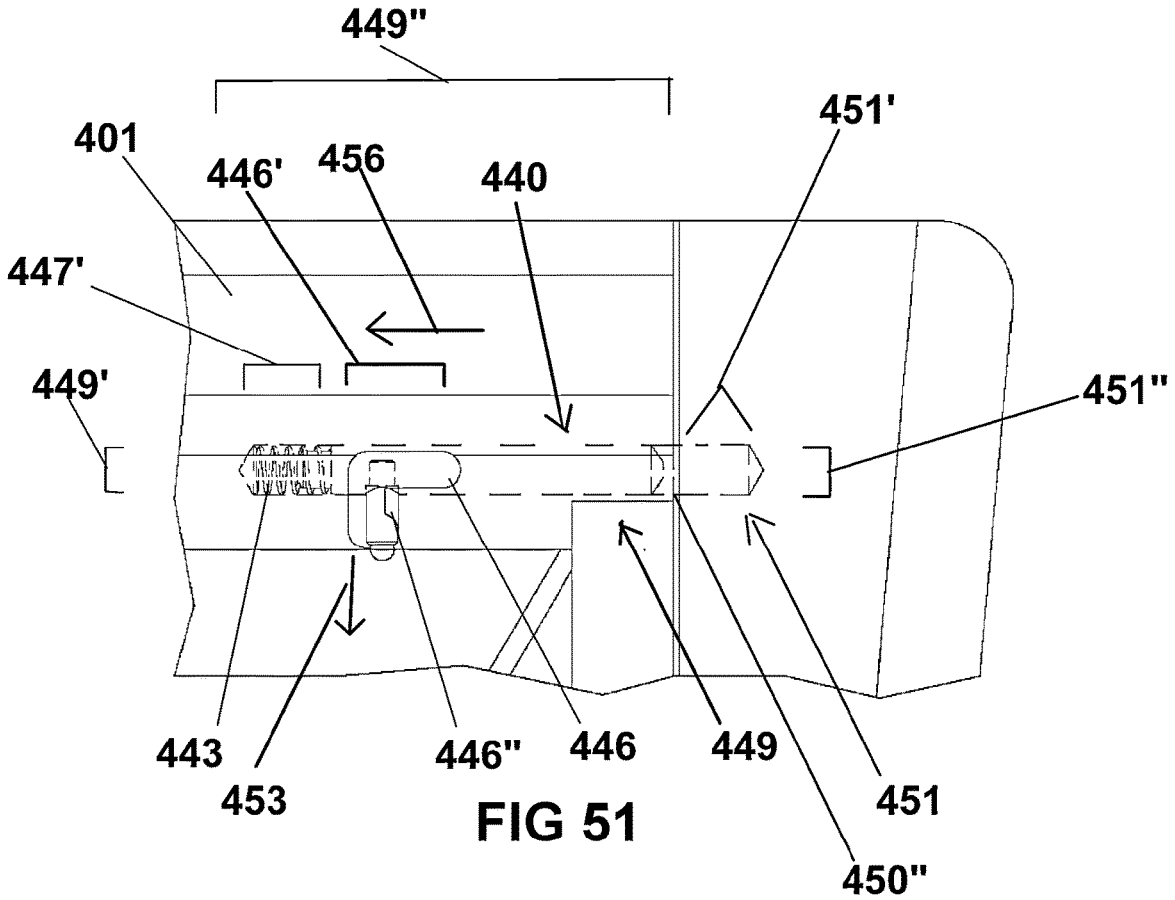
FIG. 51 is a side, close-up view of the locking mechanism of FIG. 47, with the locking pin retracted into the rear stock or buttstock to compress the spring, retracting the rear end of locking pin from the locking pin aperture in the shoulder rest, disengaging from same, the locking pin retained in retracted position via the locking pin handle positioned to engage locking slot, thereby allowing the shoulder rest to pivot via the pivot mechanism with the proper application of bias thereto by the user.
Figure 52:
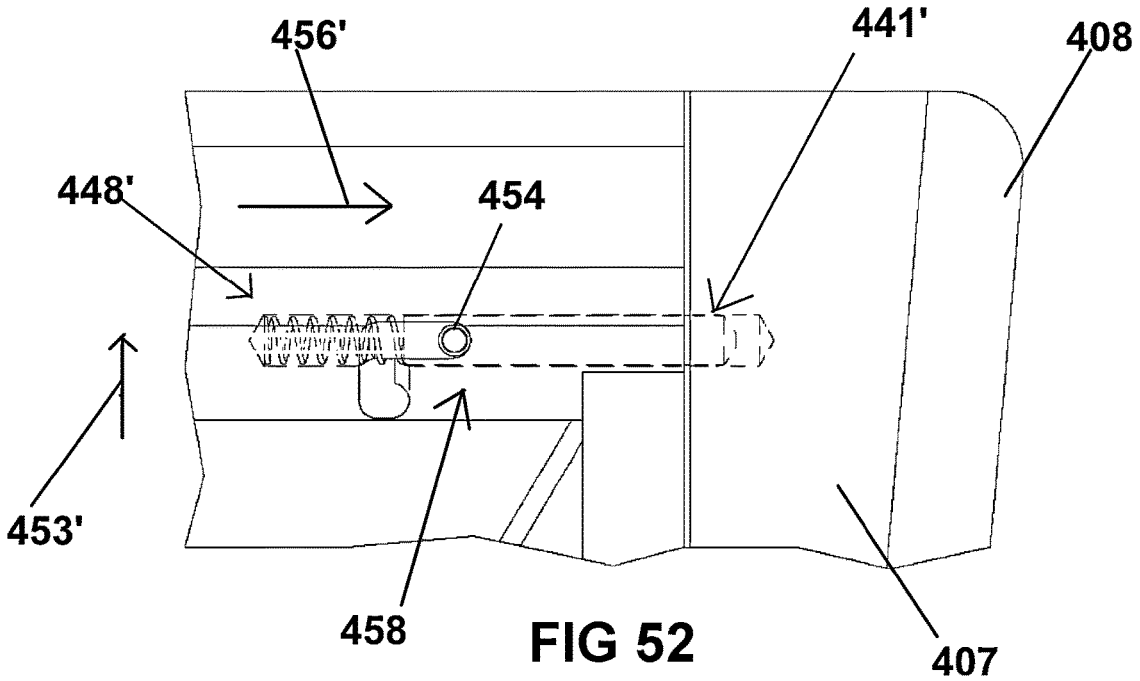
FIG. 52 is a side, partial, close-up of the locking pin of the invention of FIG. 51 illustrating the locking pin handle disengaged from the locking slot, allowing the coil spring to decompress and urge the rear end of the locking pin into the locking pin aperture in the shoulder rest, engaging same to prevent pivoting of the shoulder rest and thereby locking the pivot mechanism.

For example, as shown in the previously described minimalist embodiment 300' in FIGS. 35-36, there was provided a spacer or base 306 at the buttplate 302 upon which the flange 305 of the pivot mechanism P was mounted, while in contrast, in the present conventional embodiment 400' shown in FIGS. 47-49, no spacer or base is required, with the flange 405 of the pivot mechanism P' shown mounted directly to the end of the buttstock 401 (with or without a buttplate 402) and without the need for a spacer.

Another minor difference is that the rotation post receiver 409 of the present embodiment is formed to receive 423 the rotation post 403 with the centering spring 413 situated thereabout prior to insertion, then secured in neutral position via centering anchor threaded fastener 421 between the first and second legs 415, 415', which, like the previous embodiment are configured to receive and provide bias to centering tab 421 from flange 405 upon pivoting 433, 433' of the firearm, as previously disclosed. This is as opposed to the use of a separate spring slot 316 shown in the previous minimalist embodiment 300' of FIGS. 35-46, which could be utilized in the present embodiment, but is not believed required.

Continuing with the invention of FIGS. 47-52, the pivot mechanism P' of the conventional embodiment 400' of the present invention is largely housed in the rotation post receiver 409 of the buttstock pivot piece 407, so as to conceal it from view and provide an outward appearance of a more conventional-style shoulder rest, with the sides and upper and lower portions of same having a symmetry with the lines of the firearm and rear stock/buttstock. The flange 405 is shown situated in receiver at the end of the buttstock, so that when in neutral or zero-degree orientation, the first end 418 of the buttstock pivot piece 407 is situated adjacent to end of buttstock 401.

The present embodiment of the invention provides generally the same pivot mechanism elements and operation as taught in the previous embodiment of FIGS. 35-46, and accordingly provides the capability of enabling the user to pivot the firearm 400 in either direction to a predetermined amount of degrees (shown in the present illustration about forty-five degrees) from a center or neutral position, which is relative to the shoulder rest when resting against the user's shoulder, the present invention providing spring bias to return to pivoted firearm the center position once the user is done pivoting, or when the user removes the firearm from said user's shoulder, as described in the prior embodiment.

In addition to the more conventional-appearing rear stock or buttstock and shoulder rest, and the aforementioned return-to-center pivot capability via pivot mechanism P', the present conventional embodiment 400' also has the capability to selectively lock or release the pivot mechanism P' via a locking mechanism 458.

As shown, the locking mechanism 458 comprises a lock pin 440 having a length 440', and first 441, and second ends 441', and an outer diameter (OD) 441", the first 441 end having formed thereabout a spring guide 442 having a reduced OD 443' to receive the inner diameter (ID) 447 of a coiled or helical spring 443, the spring also having an outer diameter (OD) 447', the second 441' end of lock pin 440 formed to have a beveled tip 442'.

A lock pin passage 449 is shown formed internally along the rear stock or buttstock 401 in general longitudinal alignment with the firearm 400, the lock pin passage 449 having an inner diameter (ID) 449' and a length 449" adequate to slidingly receive the length 440' of the lock pin 440 as well as spring 443 in its compressed 448' state, as will be more fully discussed herein. The length 449" of the lock pin passage 449 provides first 450 and second 450' ends, the second end 450' terminating at opening 450" formed in buttplate 402, for allowing the selective passage of the second end 441' of lock pin 440 therethrough to engage lock pin pocket 451 formed in the first end 418 of buttstock pivot piece 407, the lock pin pocket 451 having a depth 451' and OD 451" formed to receive said second end 441' of lock pin 440, so as to lock the position of buttstock pivot piece 407 and shoulder rest 408 in alignment with rear stock or buttstock 401, and thereby prevent pivoting 433, 433' of same.

A slot 446 having length 446', and lateral catch 446' is formed through the side of the rear stock or buttstock 401 to provide access to lock pin passage 449 by lock pin handle 454. Lock pin handle 454 has first 454' and second 454" ends, the first 454' end formed to threadingly engage threaded aperture 455 formed in lock pin 440, via said slot 446, as discussed below.

In use, the second end 457' of spring 443 is slid 446 or positioned over the spring guide 442 formed at the first end 441 of lock pin 440, and said first end 441 and length 440' of lock pin 440 with spring 443 (without lock pin handle 454) is slid 45' into lock pin passage 449 via opening 450".

With the lock pin 440 positioned in lock pin passage 449, the first 454' end of lock pin handle 454 is positioned to pass through slot 446 to threadingly engage threaded aperture 455 formed in lock pin 446.

With the lock pin 440 installed in lock pin passage 449, lock pin handle 454 can then be grasped by the user to slide 456 the lock pin 440 forward and away from the shoulder rest 408 and buttstock pivot piece 407, repositioning the lock pin 440 while providing a compressed 448 spring 443 against the first end 441 of lock pin 440, with the second 441' of lock pin 440 situated within lock pin passage 449 and thereby disengaged from lock pin pocket 451 in buttstock pivot piece 407, at which point lock pin handle 343 can then be latched latched by urging said lock pin handle down 453 to engage catch 446", placing the lock pin 440 in a disengaged state, wherein the buttstock pivot piece 407 and shoulder rest 408, are allowed are free to pivot via the pivot mechanism P' as determined by the user.

To engage the locking pin from the disengaged state, lock pin pocket 451 of buttstock pivot piece 407 is aligned with the opening 450 of lock pin passage 449, by aligning the shoulder rest 408 with the rear stock or buttstock 401 in a neutral position. The user then grasps the lock pin handle 454 and lifts 453' to unlatch same from catch 446', freeing the lock pin 440 to allow the compressed 448 spring 443 to uncompress 448', urging the lock pin 440 with lock pin handle 454 in slot 446 towards the buttstock pivot piece 407, so that the second end 441' of lock pin 440 exits lock pin passage 449 via opening 450" and into lock pin pocket 451, engaging said buttstock pivot piece 407 and preventing pivoting of same.

It is emphasized with either embodiment (400 or 400'), the description of the pivot mechanisms disclosed above P and (P'), respectively, are not intended to be limiting as to the size, scale, materials used, mounting technique to the buttstock and other factors, and certain aspects of the pivotal mechanism can vary depending on the overall design of the shoulder rest and buttstock (or rear stock) and operational characteristics.

The present invention thereby allows a user the option of choosing from a variety of aiming options in real time by mounting an aiming option about the firearm as disclosed above, then utilizing the pivotal or swivel connection of the firearm to the buttstock pivot post and associated shoulder rest as earlier discussed to pivot and axially orient the firearm along its longitudinal axis to reposition the firearm to provide line-of-sight access to the desired aiming option by the user while in use.

Based on the above, a summary of a method of use of the present invention could comprise, for example, the steps of:

a. providing a gun having rear stock having a butt plate,
b. providing a pivot mechanism associated with said rear stock, said pivot mechanism including a pivot piece having an outer diameter, said pivot mechanism further having a base formed to engage said butt plate;
c. providing:
   a shoulder rest formed to engage said rear stock via said pivot mechanism, so as to provide a pivotal connection;
   a first sight mounted to said firearm along said longitudinal axis of said firearm;
   a second sight mounted to said firearm along said longitudinal axis of said firearm so that said second sight is pivotally spaced from said first sight;
b. providing a spring associated with said pivot mechanism to provide bias when pivoting said gun along a longitudinal axis relative to said shoulder rest from a neutral position wherein said shoulder rest and said gun are in longitudinal alignment;
c. using said gun, comprising the sub-steps of:
   i. applying the shoulder rest of the gun to a shoulder of a user;
   ii. using said pivot mechanism to move said gun relative to said shoulder rest via swivel movement to position said gun for aiming at a target;
   iii. allowing said swivel movement to cause said spring to provide bias in the form of resistance to pivoting as said gun is pivoted from the neutral position, said bias urging said firearm to be pivoted back to the neutral position as user bias diminishes, providing pivotal bias;
d. using said pivotal bias to provide feedback to the user to confirm said gun is at a predetermined orientation relative to said shoulder rest and one of said first or sights mounted at distinct angles relative to the length of said gun, so as to provide alternative sighting via line-of-sight alignment with the user and said target via pivoting said firearm relative to said user; and
e. using said pivotal bias to pivot said shoulder rest back and firearm back to neutral alignment upon removal of said shoulder rest from said shoulder of said user.

Further, one expression of the above pivot mechanism may be summarized as follows:

A pivot mechanism for connecting a shoulder rest to a rear stock on a gun, wherein there is provided:

a rotation post having first and second ends, and an outer diameter;
a torsion spring having first and second legs and an inner diameter, said inner diameter of said torsion spring situated about said outer diameter of said rotation post;
a rotation post receiver having an inner diameter formed to receive said second end of said rotation post and said torsion spring;
a centering tab associated with rotation post, said centering tab having a length situated between said first and second legs of said torsion spring;

whereby with said rear stock and shoulder rest in alignment, upon placing shoulder res upon a shoulder of a user, and pivoting said gun and rear stock relative to said shoulder rest, said rotation post and said centering tab pivot to engage said first or second leg of said torsion spring so that said torsion spring provides bias to resist pivoting and dis-alignment, while providing user feedback and facilitating re-alignment of said shoulder.

ELEMENTS OF THE INVENTION

I Invention
T Extension Tube
S pocket of shoulder
U User
E Eye
L Longitudinal axis of firearm
C cheek rest
P,' Pivot mechanism
1 firearm
2 receiver
3,' first, second ends
4 barrel
5 stock
6,' first, second ends
7 tang
8 butt
9,' heel, toe
10,', ball-joint carrier, butt plate
11,',," first slot, length, opening
12,' second slot medially situated
13,' length, width
14 pivot ball retainer
15 threaded passage
16 ball joint
17,',," ball, nut/socket, top
18 neck
19 base
20,' threaded shaft, ball OD
21 nut
22 ID
23,' first, second open ends
24,' lip, slidingly envelope
25,' threaded area, taper
26,',," friction washer, OD
27,',," ID, first, second opposing open ends
28,', edge, taper
29 ball outer surface
30 adjustable buttstock connector
31,' first, second ends
32,' length, medial area
33,',," front, rear, radially curved
34,' first, second threaded passages
35 swivel extension
36,',," OD, threaded portion, length
37,' socket, inner wall formed to engage outer surface of top of ball
38 slidably adjustable
39,' tightened, loosened
40 shoulder rest
41 length
42,',," first side, second side, radius
43,' first, second ends
44,' first slot, opening
45 second slot aligned w/first
46 width
47 position lock plate
48,' width, length
49,' first, second passages
50 countersunk
51,' threaded fasteners
52,' loosening, tightening
53 sliding
54 wrench
55,' relief pad, slot
56 desired position
57 line of sight
58,' axial rotation
59,' pivot vertical
60,' pivot horizontal
61 tip
62, 62' upper/top lower bottom rails
63, 63' inner, outer side rails
64 ninety-degree position
65,' top, bottom of firearm
66,' inner, outer side of firearm
67 telescopic sight or scope
68,' iron or open site
69 reflex sight
101 firearm
102 receiver
103,' first, second ends
104 barrel
105 stock, halves 105', 105"
106,' first, second ends
107 tang
108 butt
109,' heel, toe
110 butt plate
111,',," first slot, length, opening
112,' second slot medially situated
113,' length, width
114 pivot ball position lock plate
115 threaded passage
116,' pivot ball, bearing shaft
117,',," ball, nut/socket, top
118,' neck, boss
119 base, flat
120,' threaded shaft, ball OD
121,' nut, adjustable swivel connection
122 ID
123,' first, second open ends
124,' lip, slidingly envelope
125,' threaded area, taper
126 friction washer
127 ID
128 center axis point
129,' ball outer surface, pivot ball shaft
130 buttstock connector
131,' first, second ends
132,' length, medial area
133,',," front, rear, radius
134,' first, second threaded passages
135 swivel extension
136,',," OD, threads, length
137,' socket, inner wall formed to engage outer surface of top of ball
138 slidably adjustable
139,' tightened, loosened
140,',," shoulder rest, first, second components
141 length
142,',," first side, second side, radius
143,' first, second ends

144,' first slot, opening
145 second slot aligned w/first
146 width
147 position lock plate
148,' width, length
149,' first, second passages
150 countersunk
151,' threaded fasteners
152,' loosening, tightening
153 sliding
154 wrench
155,' relief pad, slot
156 desired position
157,' line of sight
158,' axial rotation
159,' pivot vertical
160,' pivot horizontal
161 tip
162, 162' upper/top lower bottom rails
163, 163' inner, outer side rails
164 ninety-degree position
165,' top, bottom of firearm
166,' inner, outer side of firearm
167 telescopic sight or scope
168,',",'" first, second, iron or open sites
169 reflex sight
170,',," fasteners
171 passage
172.',," extension tube receiver, elements
173,' squeezing, releasing
174,',," adjustment pin, first, second ends
175 lever
176 spring
177 ID tube receiver
178, 178' pivot lever
179 stock position
180,' retract, urges
181 rotate
182,' first, second ends of ball 116
183 passage
184 ball pocket
185 threaded passage
186, fastener, threadingly engage
187,' upper, lower ends of stock
189 pass
190' first, second ends of grooves
191, insert, concave ID
192 lateral passage, depth width
193 helical spring, length
194,' ball bearing, OD
195,',," grooves
196,',," groove length, width, depth
197 groove radial wall
198,' groove edges
199,' grooves
200 outwardly biased
201,' shaft depth, ID
202,' Lock Nut, ID
203,',," zero, forty-five, ninety degrees
300 firearm
300' minimalist embodiment
301 buttstock (minimalist style)
302 buttplate
303 rotation post
304,',," outer diameter, length, threaded aperature
305 flange
306 spacer or base
307 buttstock pivot piece
308 shoulder rest
309 rotation post receiver
310 ID, Depth, screw aperture
311 screw aperture
312 Friction washer (PTFE)
313 centering spring
314,' loop, ID, OD
315,',," first, second legs, space therebetween
316 spring slot
317 laterally positioned
318,' first end, second end
319 shoulder rest screw or threaded connector head receiving inset
320 threaded fastener
321, threaded fastener, threaded aperture (centering anchor)
322,',," length, width, depth
323 insertion
324 insertion
325 self-lubricating (ex PTFE) washer
326 radial slot
327 centering tab emanating from flange 305 of rotation post 303
328 zero degree or neutral position
329 centering tab positioned
330,',",'" radial slot length, first, second ends, medial area
331 line of site at zero degrees
332 positions
333,' right, left pivot
334,' radial slot 45 degree stop
400 firearm
400' conventional embodiment
401 rear stock or buttstock
402 buttplate
403 rotation post
405 flange
conventional or traditional style)
407 buttstock pivot piece, second embodiment
408 shoulder rest (conventional or traditional style)
409 rotation post receiver
413 centering spring
418 first end buttstock pivot piece
421 centering anchor threaded fastener
423 receive
433,' pivoting
440,' lock pin, length
441,',," first, second ends, OD
442,' spring guide, beveled tip
443 spring, spring guide OD
444,' lock pin threaded aperture, threaded end
445,' lock pin, length, OD
446,',' slot, length, catch
447' ID, OD
448,' spring compressed, uncompressed
449,' lock pin passage, ID, length
450,',," first, second ends, open
451,',," lock pin pocket in first end buttstock pivot piece, depth, OD
452,' slide lock, unlock
453,' latch, unlatch
454 lock pin handle, first, second ends
455 threaded aperture
456 slid,'
457,' first, second ends of spring 443
458 locking mechanism The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. A pivot mechanism for connecting a shoulder rest to a rear stock on a gun, comprising:

a rotation post having first and second ends, and an outer diameter;

a torsion spring having first and second legs and an inner diameter, said inner diameter of said torsion spring situated about said outer diameter of said rotation post;

a rotation post receiver having an inner diameter formed to receive said second end of said rotation post and said torsion spring;

a centering tab associated with rotation post, said centering tab having a length situated between said first and second legs of said torsion spring;

whereby, upon engaging said shoulder rest to a shoulder of a user with said shoulder rest and gun in a neutral position, and pivoting said gun and rear stock relative to said shoulder rest from said neutral position, said rotation post and said centering tab pivot to engage said first or second leg of said torsion spring so that said torsion spring provides bias to resist pivoting, while providing user feedback as to position while facilitating re-alignment of said shoulder rest and rear stock upon disengaging said shoulder rest from said user's shoulder.

2. The apparatus of claim 1, wherein there is further provided a locking pin situated in a passage one of said rear stock or said shoulder rest, whereby an end of said locking pin can be selectively extended from one of said rear stock or said shoulder rest so as to prevent pivoting of same.

3. The apparatus of claim 2, wherein said locking pin is spring-biased within a locking pin passage.

4. The apparatus of claim 3, there is provided a slot associated with said rear stock to provide access to said locking pin via a locking pin handle.

5. The apparatus of claim 4, wherein there is provided a latch to selectively lock said locking pin in position within said locking pin passage via engagement with said locking pin handle.

6. The apparatus of claim 5, wherein said rotation post receiver is situated in a buttstock pivot piece, which includes said shoulder rest.

7. The apparatus of claim 6, wherein said second end of said rotation post engages said buttstock pivot piece via a threaded fastener through said shoulder rest.

8. The apparatus of claim 7, wherein said first end of said rotation post comprises a flange associated with an end of said rear stock.

9. The apparatus of claim 8, wherein said centering tab emanates from said flange.

* * * * *